US011293385B2

(12) United States Patent
Rabhi

(10) Patent No.: US 11,293,385 B2
(45) Date of Patent: Apr. 5, 2022

(54) FORCED RECIRCULATION MIXER

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 0 days.

(21) Appl. No.: 17/195,875

(22) Filed: Mar. 9, 2021

(65) Prior Publication Data

US 2021/0340937 A1 Nov. 4, 2021

Related U.S. Application Data

(60) Provisional application No. 63/017,087, filed on Apr. 29, 2020.

(51) Int. Cl.

| | |
|---|---|
| ***F02M 29/02*** | (2006.01) |
| ***F02M 51/04*** | (2006.01) |
| ***F02M 67/00*** | (2006.01) |
| ***F02M 59/36*** | (2006.01) |
| ***F02M 59/46*** | (2006.01) |
| ***F02M 53/02*** | (2006.01) |

(52) U.S. Cl.

CPC ..... *F02M 29/02* (2013.01); *F02M 51/04* (2013.01); *F02M 53/02* (2013.01); *F02M 59/366* (2013.01); *F02M 59/466* (2013.01); *F02M 67/005* (2013.01)

(58) Field of Classification Search

CPC ..... F02M 29/00; F02M 29/02; F02M 59/366; F02M 59/466; F02M 67/005; F02M 2700/12–126; F02M 2700/4304–4319; F02M 2700/4361–4378

USPC ..... 123/590–592

See application file for complete search history.

(56) References Cited

U.S. PATENT DOCUMENTS

| | | | | |
|---|---|---|---|---|
| 4,353,848 A * | 10/1982 | Carsten | F02M 7/16 | 261/44.6 |
| 5,992,397 A * | 11/1999 | Hideaki | F02M 25/0854 | 123/538 |
| 2010/0000502 A1* | 1/2010 | Hassan | C10L 1/32 | 123/592 |

FOREIGN PATENT DOCUMENTS

| | | | |
|---|---|---|---|
| CN | 102182587 A * | 9/2011 | F02M 29/02 |
| FR | 3 061 743 | 8/2019 | |

* cited by examiner

*Primary Examiner* — Robert A Werner

(74) *Attorney, Agent, or Firm* — Nixon & Vanderhye

(57) ABSTRACT

The forced recirculation mixer (1) consists of a stirring enclosure (5) whose internal cavity forms a recirculation loop (6) in which circulates a homogeneous gas mixture (4) formed by a gas (3) to be mixed and a vaporizable liquid (2) respectively introduced into that loop (6) via a gas inlet duct (7) and a liquid injection nozzle (9), gas drawing-off means (12) being capable of withdrawing a homogeneous gas mixture (4) from the stirring enclosure (5) via a mixture draw-off duct (11) and a stirring turbine (13) driven by a turbine motor (28) forcing the homogeneous gas mixture (4) to circulate in the recirculation loop (6).

22 Claims, 10 Drawing Sheets

[Fig. 1]
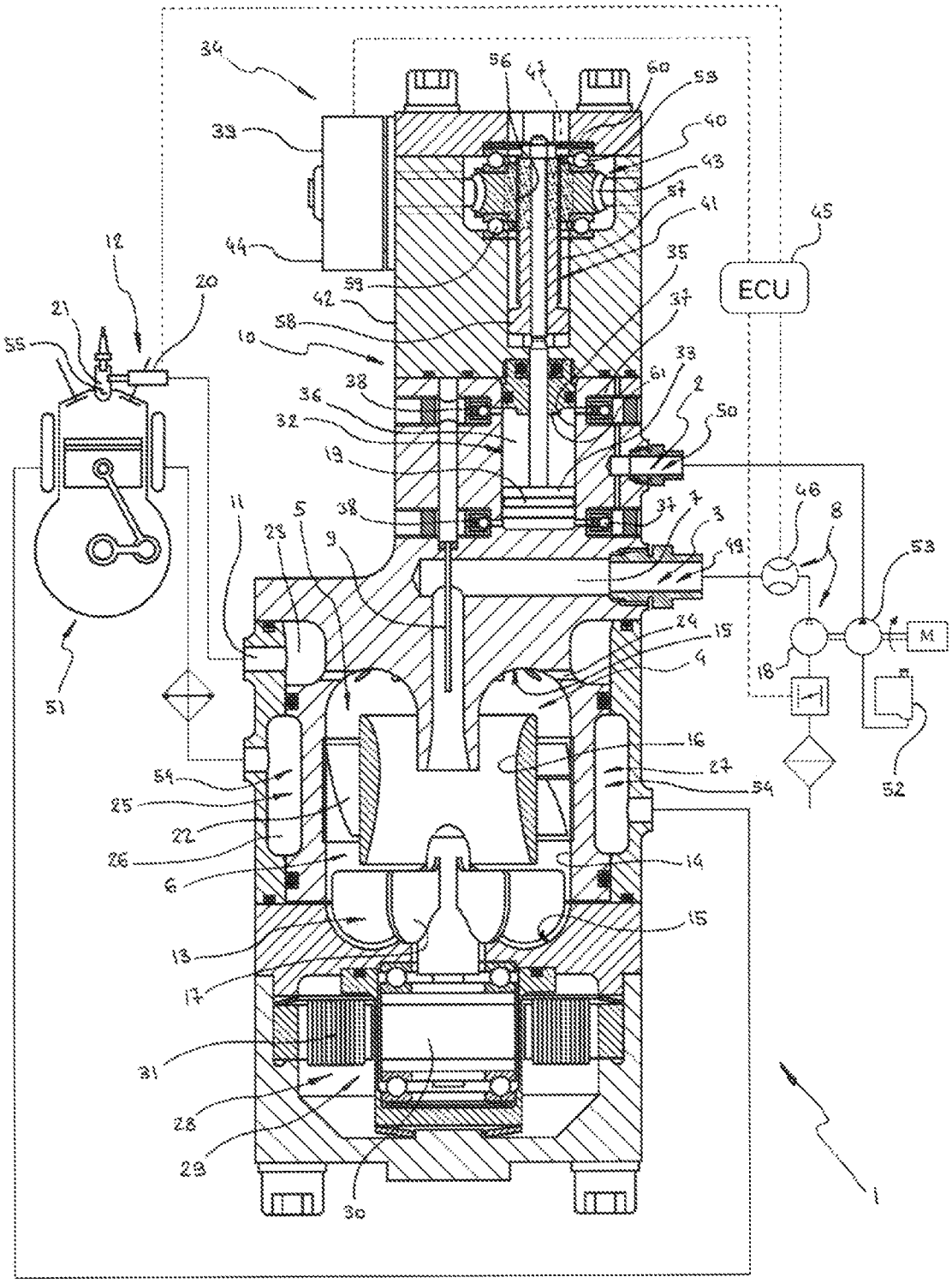

[Fig. 2]
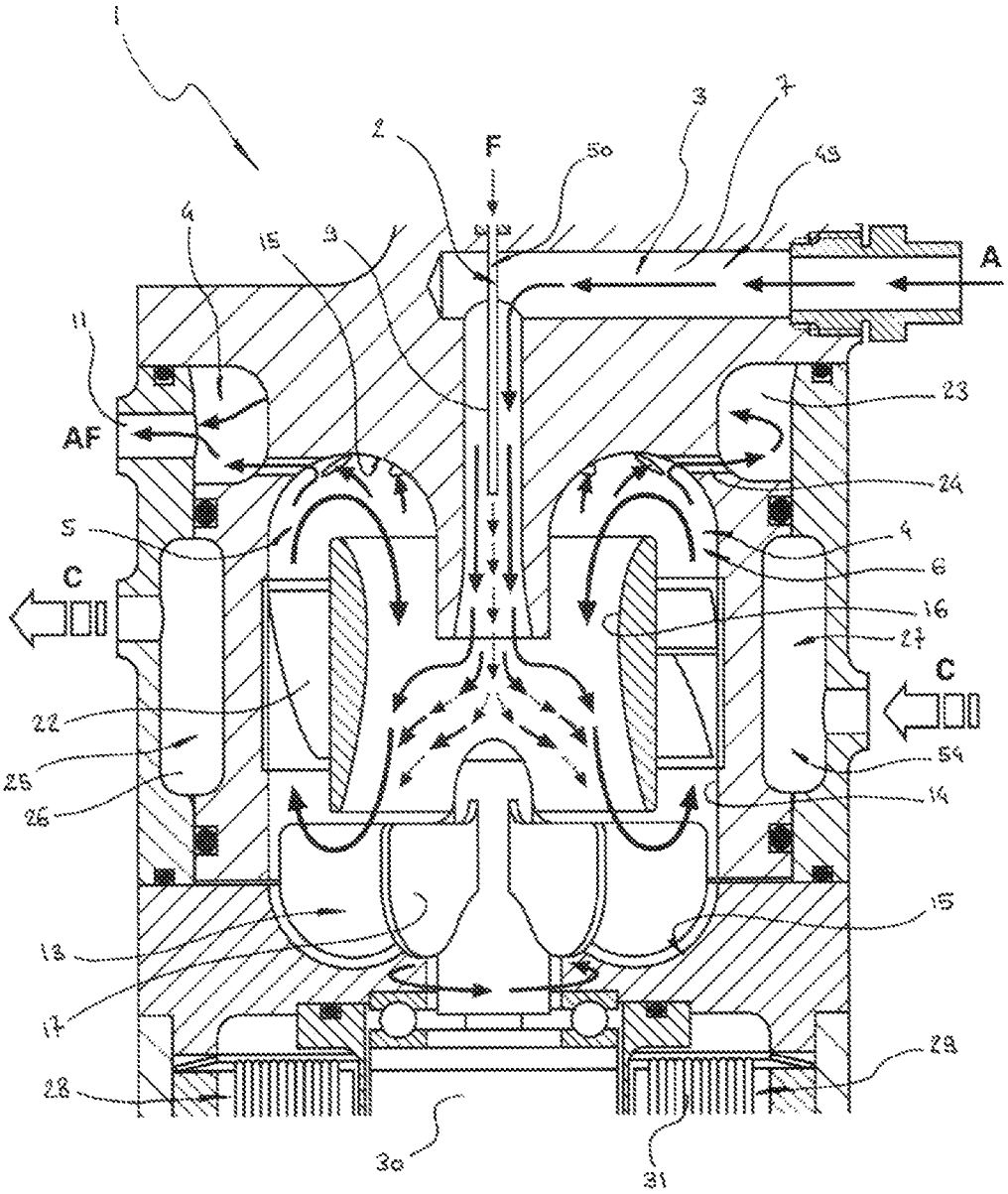

[Fig. 3]
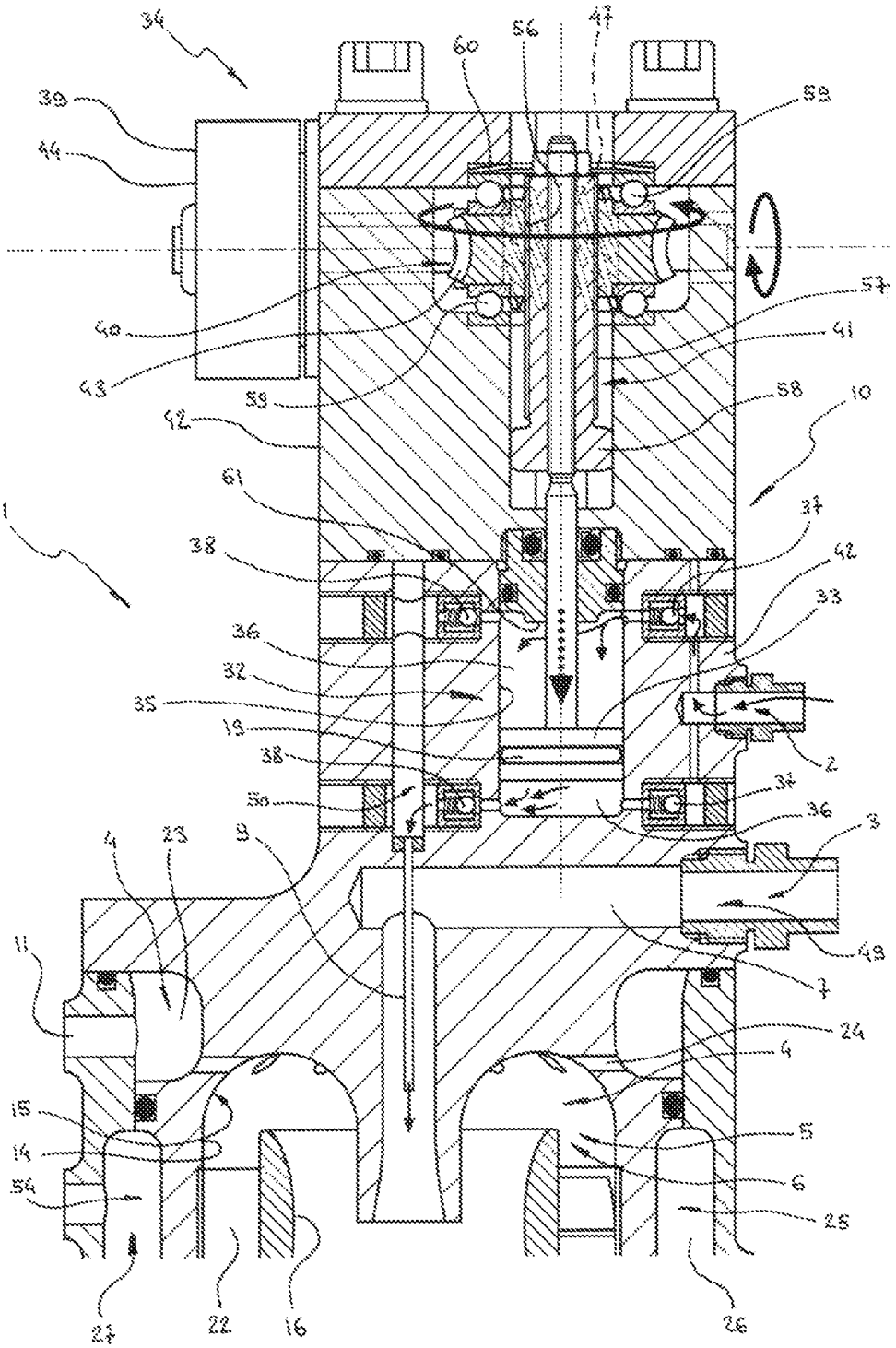

[Fig. 4]
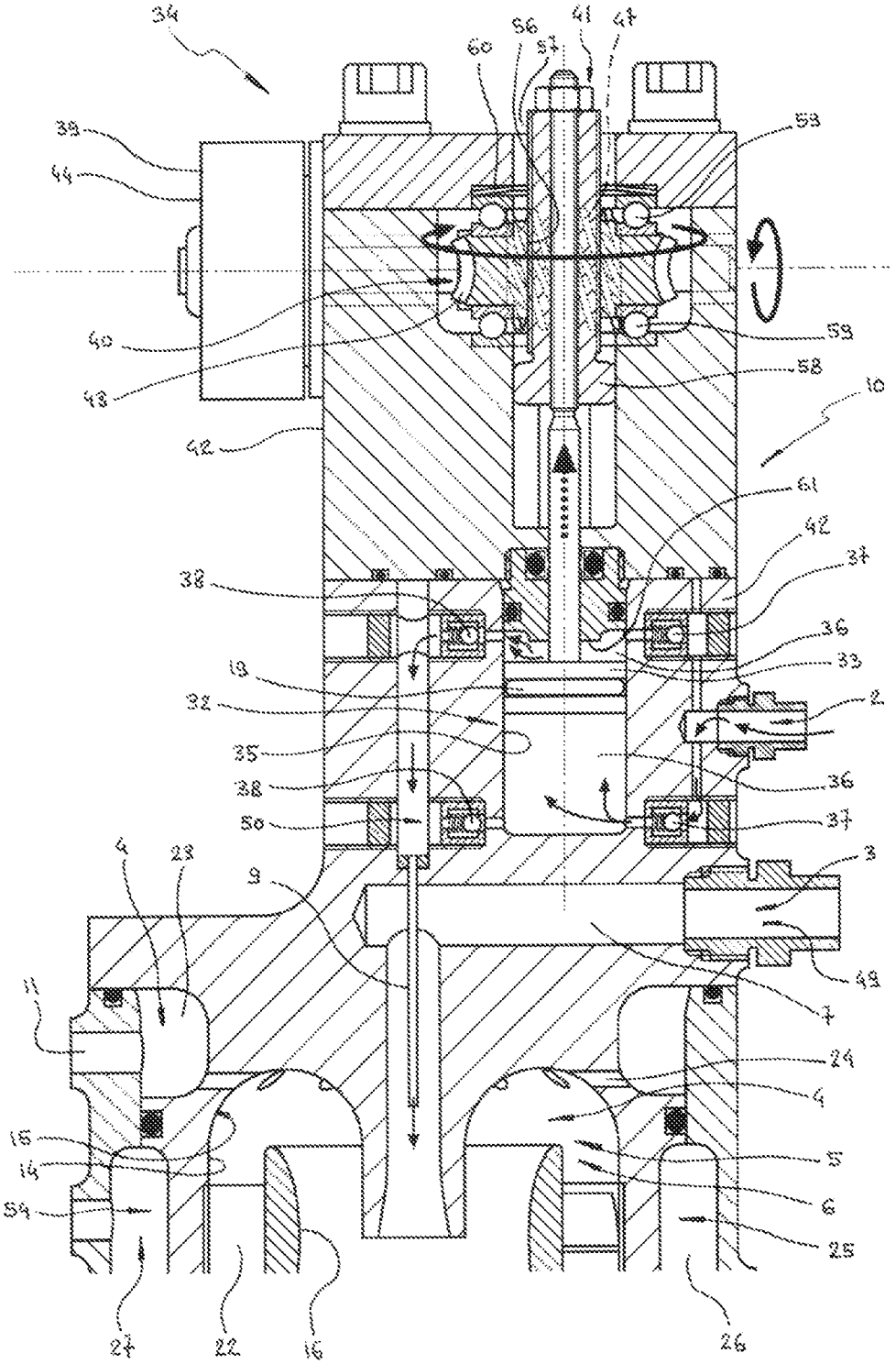

[Fig. 5]
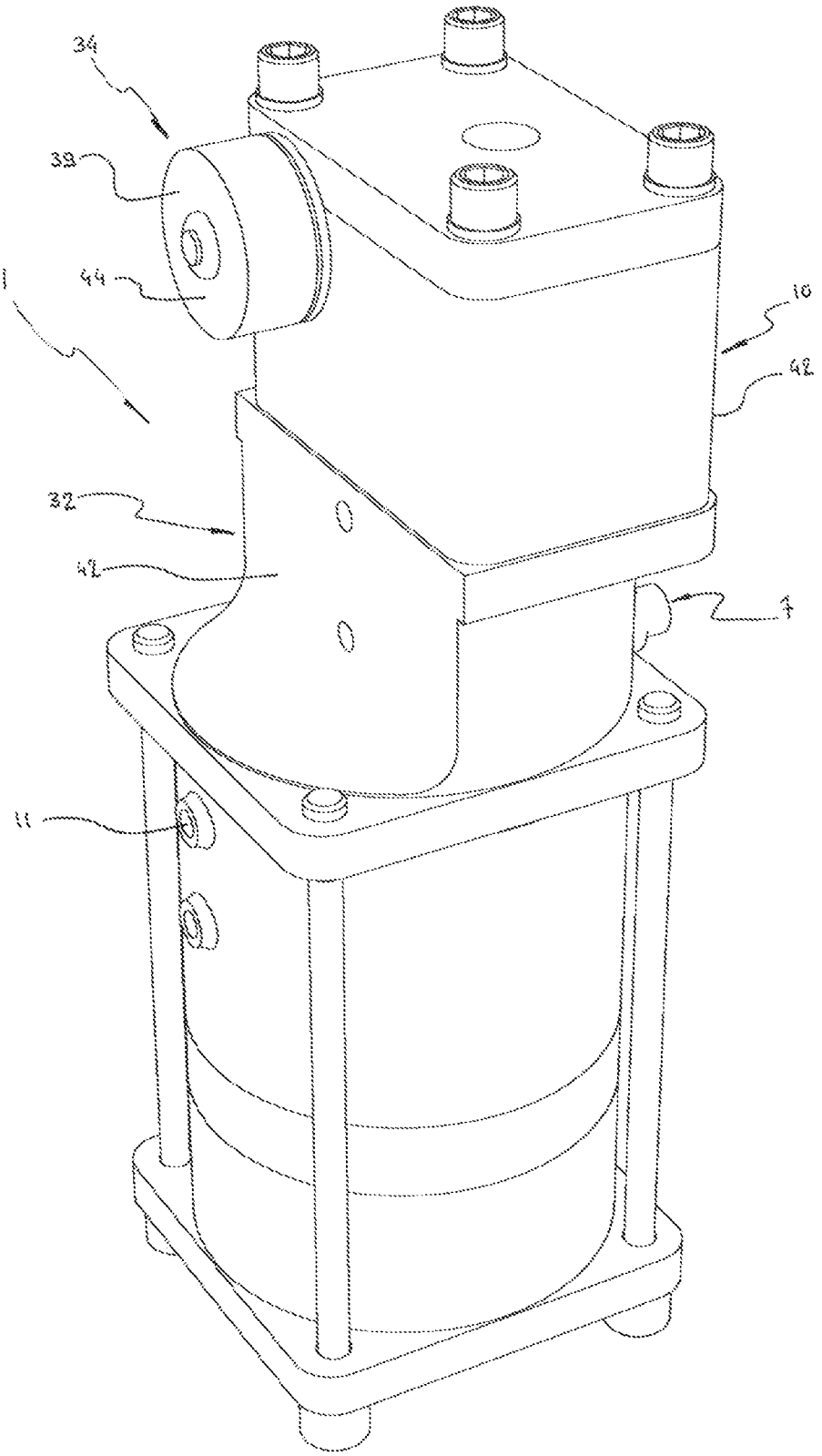

[Fig. 6]
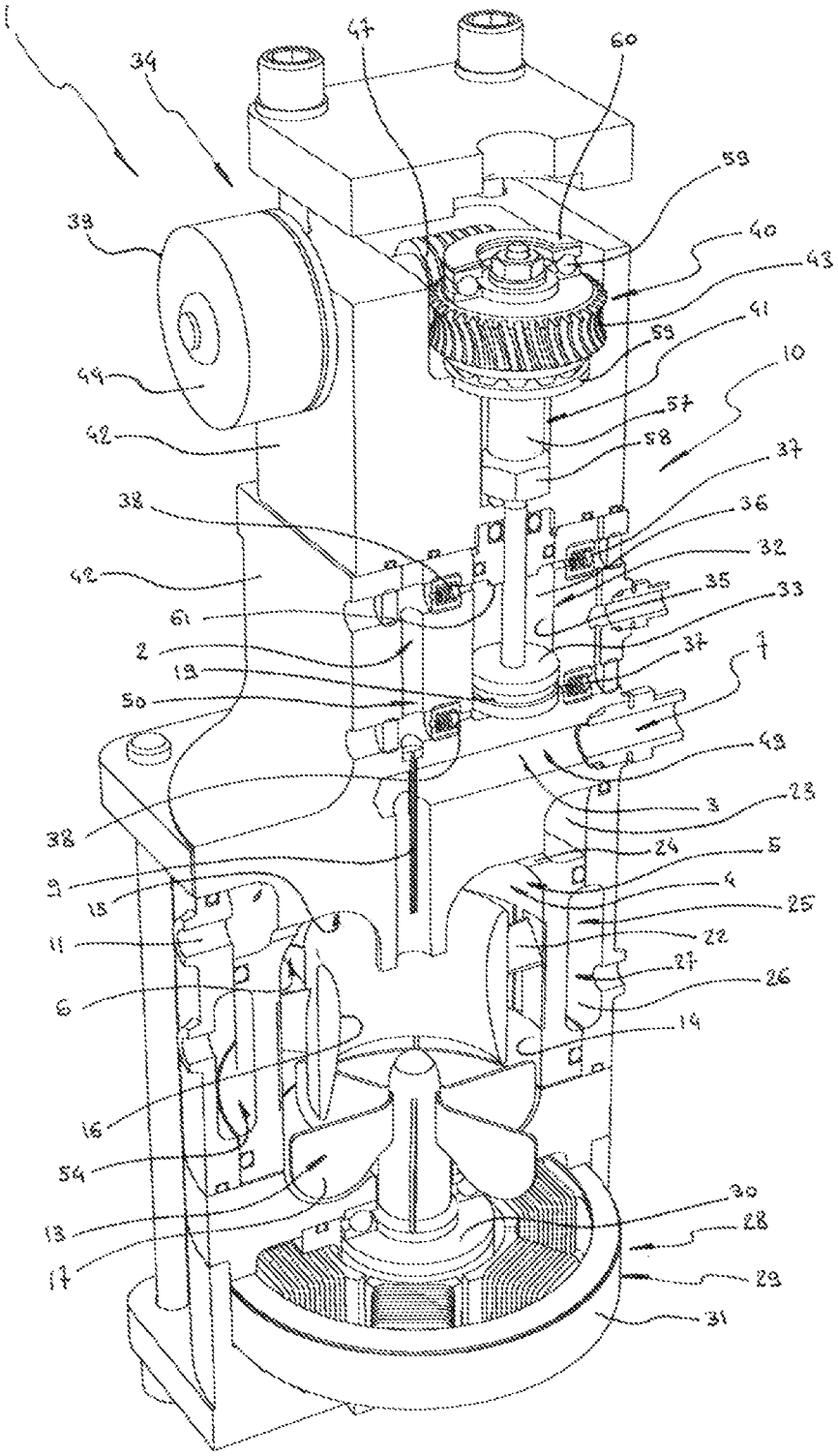

[Fig. 7]
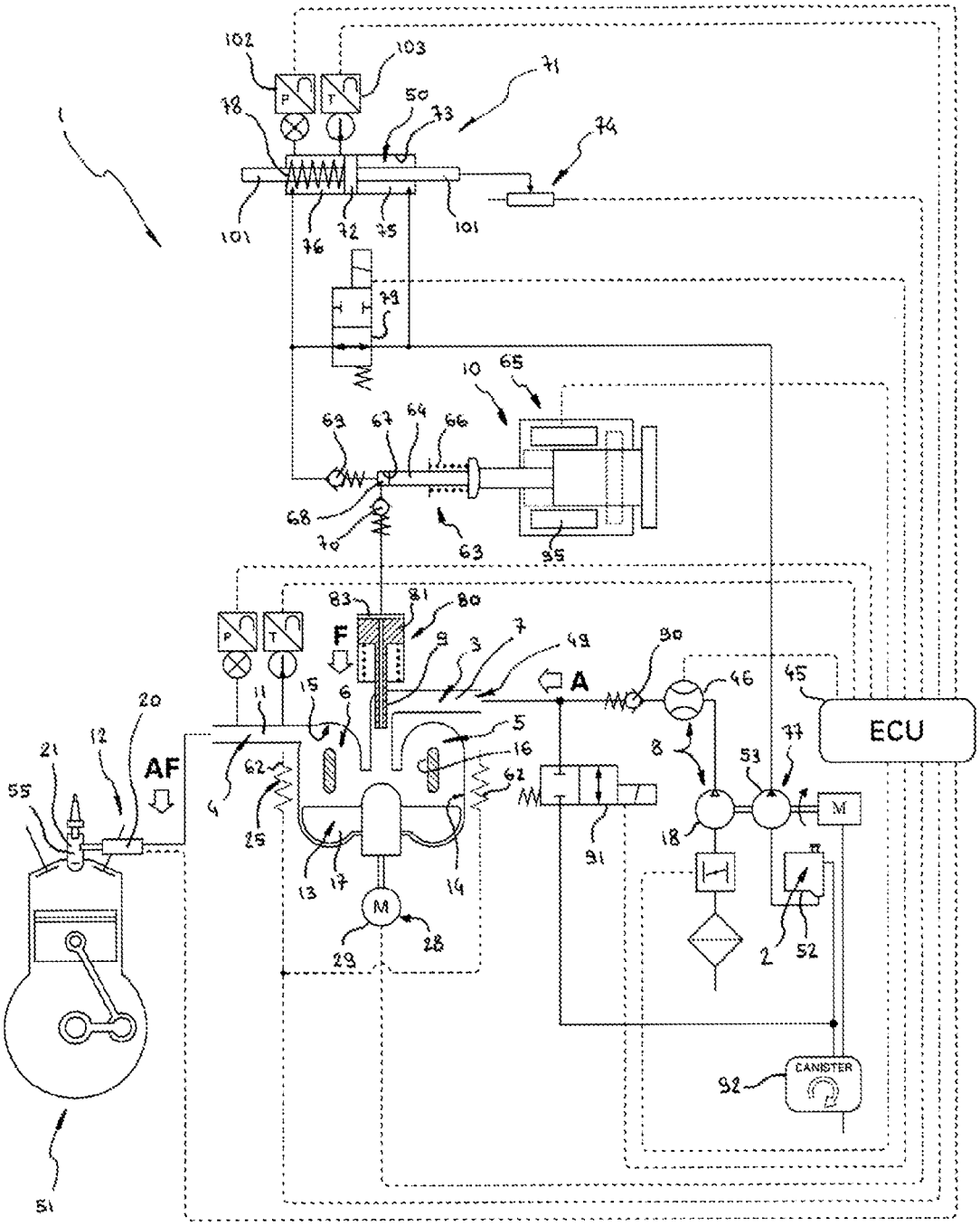

[Fig. 8]
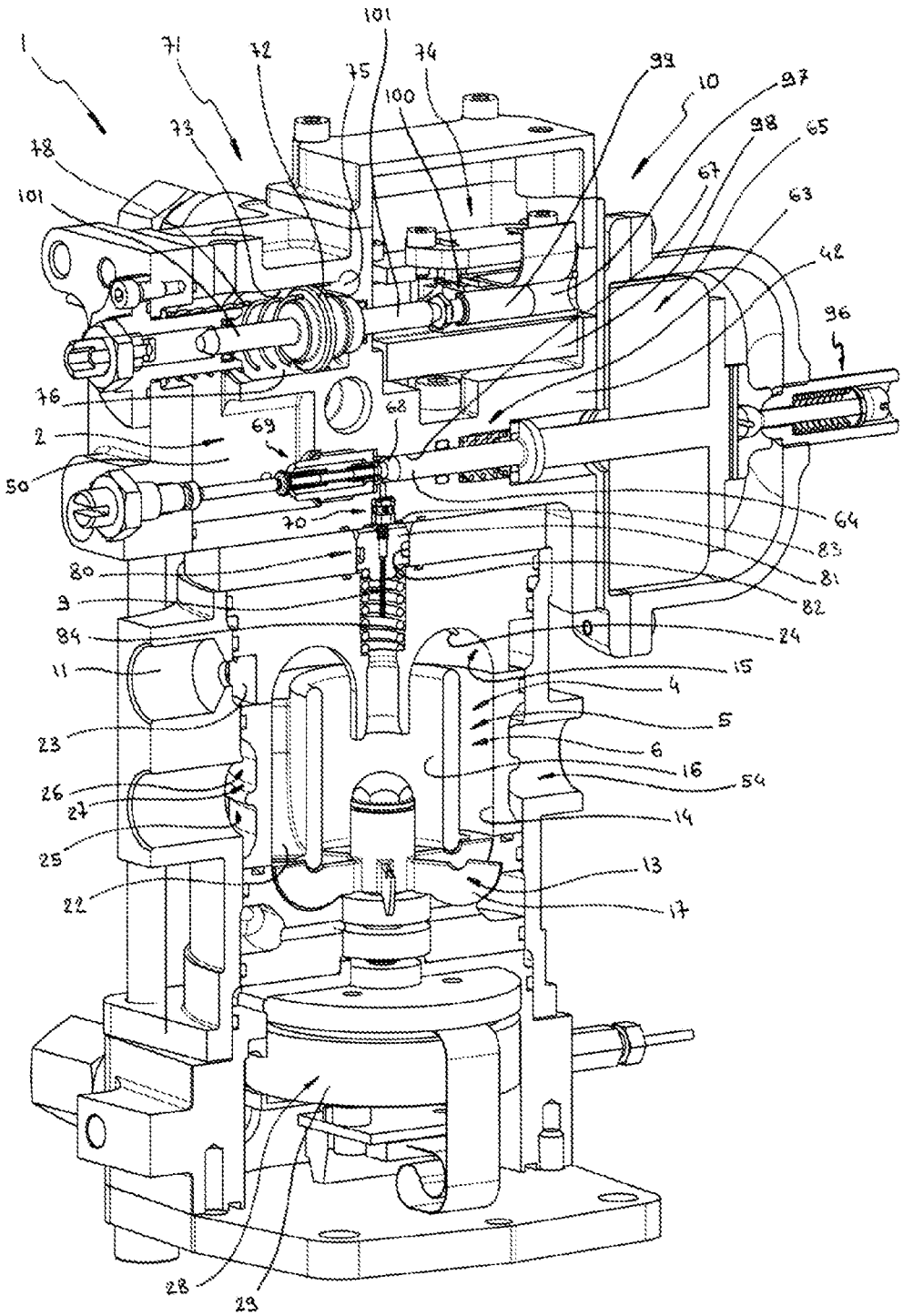

[Fig. 9]
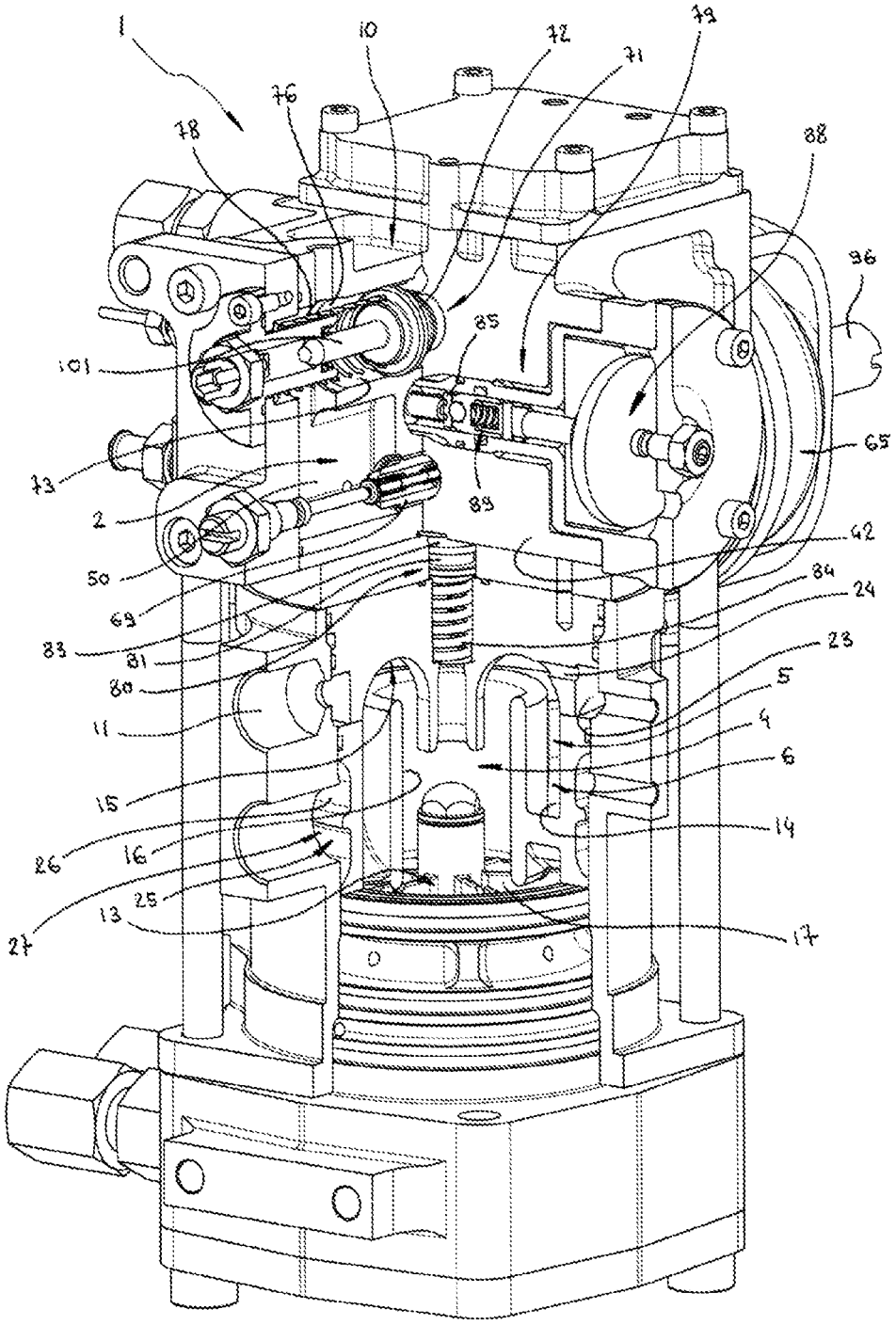

[Fig. 10]
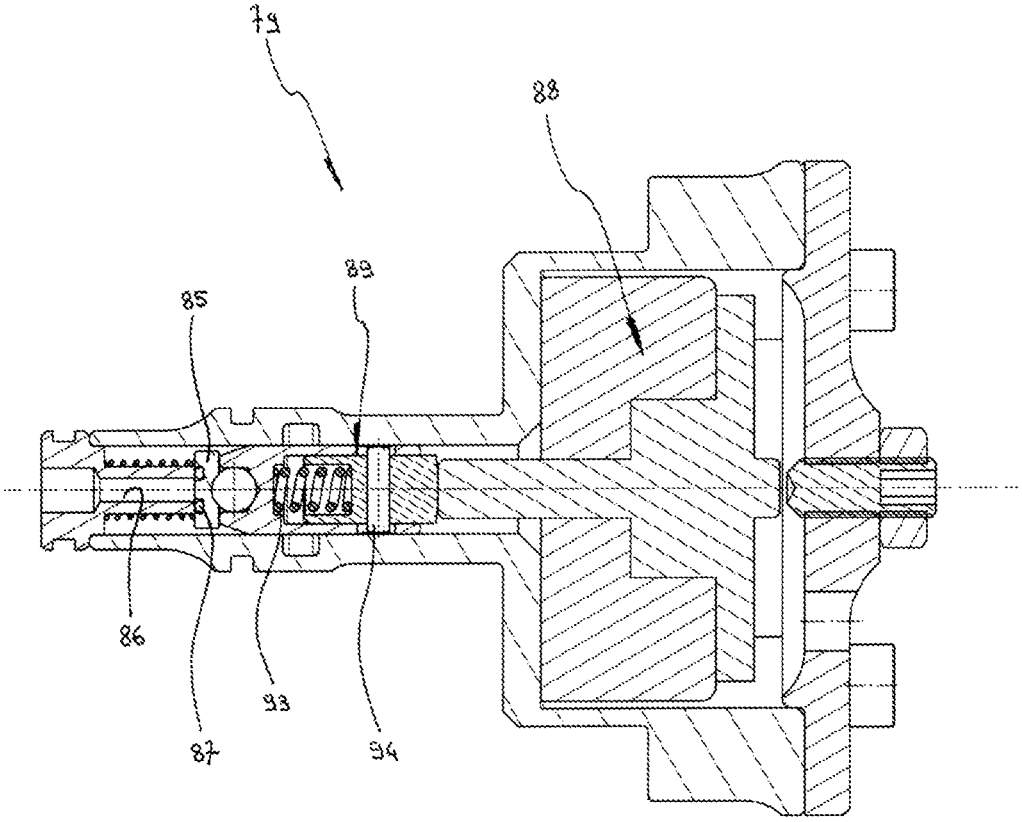

FORCED RECIRCULATION MIXER

The present invention relates to a forced recirculation mixer essentially designed to mix at least one liquid and at least one gas in determined proportions, and over a wide range of mass flow.

Said mixer according to the present invention is particularly suitable for the implementation of the valve-controlled ignition pre-chamber which was the subject of patent No. FR 3,061,743 published on Aug. 16, 2019, said patent belonging to the applicant.

Said pre-chamber is so designed that a pilot charge is injected into a stratification cavity by a stratification injector, said charge being in the majority of cases and particularly in the automotive industry consisting of a readily-inflammable air-gasoline mixture which has previously been pressurized by compression means.

The invention according to patent FR 3,061,743 is in fact particularly intended for the automotive market. However, said market is very sensitive to the cost price, weight and size of any equipment, which must remain as low as possible. The automotive market is also very demanding in terms of robustness, reliability, service life, and maintenance.

This is the context in which the valve-controlled ignition pre-chamber according to patent FR 3,061,743 falls, said pre-chamber requiring both high metering precision of the air-gasoline mixture which constitutes the pilot charge, and a high quality of preparation of said mixture which must be as homogeneous as possible.

However, the preparation of said mixture takes place at a relatively high pressure of the order of forty or fifty bars, while the flow rate of the air with which the gasoline must be mixed is very low, which flow rate of air can vary in intensity in a ratio of one hundred and fifty, or even more.

In addition, it is essential that the gasoline is fully vaporized in the air which receives it before introducing the resulting air-gasoline mixture into the stratification cavity by means of the stratification injector.

It is also essential to prevent any partial re-condensation of gasoline despite the high pressure to which the air-gasoline mixture is subjected; said re-condensation may occur if the homogeneity of said mixture is insufficient.

In fact, the quality of the combustion of the pilot charge in the stratification cavity depends both on its composition and in particular on the air/gasoline ratio of the mixture to be burned, and on its homogeneity.

It is therefore primarily to implement the valve-controlled ignition pre-chamber according to patent FR 3,061,743 that, according to a particular embodiment, the forced recirculation mixer according to the invention:

- offers great precision in injecting gasoline into the air to precisely control the air/gasoline ratio of the resulting air-gasoline mixture, despite the very low mass flow rates of gasoline involved, and despite a range of min/max flow rates of air and gasoline to encompass which can range from one to one hundred and fifty, or even more;
- guarantees complete vaporization of gasoline in the air;
- guarantees great homogeneity of the air-gasoline mixture, and the absence of any partial re-condensation of gasoline;
- can operate over a wide temperature range, compatible with the constraints of automobile engines;
- is insensitive to vibrations produced by an internal combustion engine, said vibrations not affecting the measurement accuracy of said mixer;

- exhibits automotive-compatible durability, strength and reliability;
- does not require any special maintenance;
- is light and compact.

It is to be understood that the forced recirculation mixer according to the invention can not only be applied to the valve-controlled ignition pre-chamber according to patent FR 3,061,743, but also to any other application, whatever the type or the field, which requires mixing at least one gas with at least one liquid in precise proportions and in a homogeneous manner, regardless of said gas or said liquid.

The forced recirculation mixer according to this invention is designed to mix at least one vaporizable liquid with at least one gas to be mixed so as to form a homogeneous gaseous mixture, said mixer comprising:

- At least one stirring enclosure whose internal cavity forms a recirculation loop in which the homogeneous gas mixture can circulate continuously, the beginning and the end of the recirculation loop being combined;
- At least one gas inlet duct which emerges directly or indirectly into the stirring enclosure and through which the gas to be mixed is introduced into the recirculation loop by means for the introduction of gas in a known quantity;
- At least one liquid injection nozzle which emerges directly or indirectly into the stirring enclosure to introduce the vaporizable liquid into the recirculation loop, said nozzle being fed by means for the introduction of liquid in a controlled quantity, the vaporizable liquid flow rate of which is controlled by a computer, said vaporizable liquid forming, with the gas to be mixed, the homogeneous gas mixture;
- At least one mixture draw-off duct which emerges directly or indirectly into the stirring enclosure and through which the homogeneous gas mixture can be drawn-off from the recirculation loop by gas drawing-off means;
- At least one stirring turbine which is set in motion by a turbine motor and which is positioned in the recirculation loop, said turbine forcing the homogeneous gas mixture to circulate in said loop.

The forced recirculation mixer according to the present invention comprises at least one external coaxial duct, each end of which is closed by a reversing terminating end, at least one internal coaxial duct being accommodated in the external coaxial duct and a gap being left for the homogeneous gas mixture to circulate, on the one hand, between each reversing terminating end and the internal coaxial duct and, on the other hand, between the inner face of the external coaxial duct and the outer face of the internal coaxial duct, the direction of circulation of the homogeneous gas mixture in the external coaxial duct being opposite to the direction of circulation of said mixture in the internal coaxial duct.

The forced recirculation mixer according to the present invention comprises a stirring turbine which is wholly or partly accommodated in one of the reversing terminating ends, the homogeneous gas mixture being sucked through the center of said turbine via the internal coaxial duct before being discharged to the periphery of said turbine via the gap left between the inner face of the external coaxial duct and the outer face of the internal coaxial duct.

The forced recirculation mixer according to the present invention comprises a reversing terminating end which accommodates the stirring turbine which has a hollow hemi-toroidal shape, and blades which comprises the stirring turbine having a complementary protruding hemi-toroidal shape, a small play being left between said terminating end and said blades.

The forced recirculation mixer according to the present invention comprises a gas inlet duct which passes through one of the reversing terminating ends to emerge into the internal coaxial duct.

The forced recirculation mixer according to the present invention comprises a reversing terminating end crossed by the gas inlet duct which has a hollow hemi-toroidal shape from which said duct emerges.

The forced recirculation mixer according to the present invention comprises a liquid injection nozzle which emerges into the interior of the gas inlet duct, or at the outlet thereof.

The forced recirculation mixer according to the present invention comprises an internal coaxial duct which is held in position in the external coaxial duct by at least one stirring vane which radially connects said internal coaxial duct to said external coaxial duct.

The forced recirculation mixer according to this invention comprises an external coaxial conduit or any of the reversing terminating ends thereof, which is wholly or partly surrounded by a draw-off ring, the inside of the latter being connected to the inside of the external coaxial duct by at least one radial draw-off orifice, the mixture draw-off duct being connected to the stirring enclosure by means of said ring and said orifice.

The forced recirculation mixer according to the present invention includes a stirring enclosure which includes heating or cooling means.

The forced recirculation mixer according to the present invention comprises a turbine motor which is an electric motor which comprises, on the one hand, a rotor which is rotationally connected to the stirring turbine and which is enclosed in the stirring enclosure, and on the other hand, a stator which is placed outside said enclosure, magnetic fields produced by said stator being capable to pass through the wall of the stirring enclosure to cause the rotor to rotate.

The forced recirculation mixer according to the present invention comprises means for the introduction of liquid in a controlled quantity which consist of a liquid piston pump which comprises a pump casing, said pump also comprising at least one single or double acting pump piston which, by the action of a piston actuator cooperating with displacement control means, is capable to move in translation in a pump cylinder to form at least one pump chamber of variable volume in which the vaporizable liquid can be introduced via an inlet valve, and from which said liquid can be expelled to the liquid injection nozzle via a discharge valve.

The forced recirculation mixer according to the present invention comprises a piston actuator which consists of a actuator rotary electric motor secured to the pump casing, said motor being capable to rotate in either direction in order to rotationally drive driving transmission means which are integral in translation with the pump casing and which cooperate with driven transmission means which are integral in translation with the pump piston, said driving transmission means reacting with said casing to longitudinally move in translation said driven transmission means.

The forced recirculation mixer according to the present invention comprises driving transmission means which consist of a worm which rotates a worm wheel which has a wheel thread, the driven transmission means consisting of a piston thread that cooperates with the wheel thread.

The forced recirculation mixer according to the present invention comprises a gas mass flowmeter which measures, directly or indirectly, the mass flow rate of the gas to be mixed circulating in the gas inlet duct and/or the mass flow rate of the homogeneous gas mixture circulating in the mixture draw-off duct.

The forced recirculation mixer according to the present invention comprises means for the introduction of liquid in a controlled quantity which consist of an impulse pump which comprises a single or double acting impulse pump piston which, by the action of a pump solenoid actuator, is capable to move in translation through an impulse pump cylinder with which it forms at least one impulse pump chamber of variable volume into which the vaporizable liquid can be introduced via an impulse pump inlet valve, and from which said liquid can be expelled to the liquid injection nozzle via an impulse pump discharge valve.

The forced recirculation mixer according to the present invention comprises a volume and/or mass flow rate of vaporizable liquid which is sent back to the computer by a vaporizable liquid flowmeter placed upstream or downstream of the controlled quantity liquid introduction means.

The forced recirculation mixer according to the present invention comprises a vaporizable liquid flowmeter which is constituted by a flowmeter piston which can move in a sealed manner in a flowmeter cylinder so as to form, on the one hand, a flowmeter upstream chamber which is directly or indirectly connected to a pressure source and, on the other hand, a flowmeter downstream chamber which is directly or indirectly connected to the liquid injection nozzle, the position of said piston in said cylinder being transmitted to the computer by a position sensor, a flowmeter piston return spring tending to push the flowmeter piston towards the flowmeter upstream chamber.

The forced recirculation mixer according to the present invention comprises a flowmeter upstream chamber which is connectable to the flowmeter downstream chamber by a flowmeter piston return valve.

The forced recirculation mixer according to the present invention includes a flowmeter piston return valve which includes an orientable sealing plate which can be held pressed on a valve orifice by a valve solenoid actuator.

The forced recirculation mixer according to the present invention comprises a nozzle accumulator which is interposed between the means for the introduction of liquid in a controlled quantity and the liquid injection nozzle.

The forced recirculation mixer according to the present invention comprises a nozzle accumulator which comprises a nozzle accumulator piston which, together with an accumulator cylinder, forms an accumulator chamber, said piston being pushed towards said chamber by an accumulator spring, the liquid injection nozzle being integral with said piston and passing through the latter right through in the lengthwise direction thereof.

The description which will follow made with reference to the accompanying drawings and provided by way of non-limiting examples will make it possible to better understand the invention, the characteristics thereof, and the advantages that it is likely to provide:

FIG. 1 is a schematic sectional view of the forced recirculation mixer according to the invention, the stirring enclosure of which comprises an external coaxial duct, an internal coaxial duct, and heating or cooling means, the means for the introduction of liquid in a controlled quantity consisting of a liquid piston pump whose double-acting pump piston moves in a pump cylinder being actuated by a worm driven in rotation by an actuator rotary electric motor, a worm wheel, a wheel thread and a piston thread.

FIG. 2 is a close-up schematic sectional view of the forced recirculation mixer according to the invention and according to the variant shown in FIG. 1, arrows making it possible to visualize the flows of gas to be mixed, of vaporizable liquid, and of homogeneous gas mixture.

FIG. 3 is a close-up schematic sectional view of the forced recirculation mixer according to the invention and according to the variant shown in FIG. 1, focused on the liquid piston pump, and which illustrates the operation of said pump when the actuator rotary electric motor rotates the worm clockwise.

FIG. 4 is a close-up schematic sectional view of the forced recirculation mixer according to the invention and according to the variant shown in FIG. 1, focused on the liquid piston pump, and which illustrates the operation of said pump when the actuator rotary electric motor rotates the worm counterclockwise.

FIG. 5 is a three-dimensional view of the forced recirculation mixer according to the invention and according to the variant shown in FIG. 1.

FIG. 6 is a three-dimensional sectional view of the forced recirculation mixer according to the invention and according to the variant shown in FIG. 1, the upper cover of the liquid piston pump being slightly raised to allow to see the worm driven in rotation by the actuator rotary electric motor.

FIG. 7 is an outline schematic diagram of the forced recirculation mixer according to the invention as it can be applied to an internal combustion engine which receives the valve-controlled ignition pre-chamber which is the subject of patent No. FR 3,061,743, the means for the introduction of liquid in a controlled quantity of said mixer consisting of an impulse pump which cooperates with a vaporizable liquid flowmeter in particular consisting of a flowmeter piston whose position is transmitted to the computer by a position sensor.

FIG. 8 is a three-dimensional sectional view of the forced recirculation mixer according to the invention, the means for the introduction of liquid in a controlled quantity consisting of an impulse pump which cooperates with a vaporizable liquid flowmeter in particular consisting of a flowmeter piston whose position is measured by a position sensor.

FIG. 9 is a three-dimensional sectional view of the forced recirculation mixer according to the invention and according to the variant shown in FIG. 8, said section showing in particular a normally open flowmeter piston return valve which can put the flowmeter upstream chamber in relation with the flowmeter downstream chamber.

FIG. 10 is a schematic sectional view of the flowmeter piston return valve of the forced recirculation mixer according to the invention shown in FIG. 9, said valve comprising an orientable sealing plate held pressed by a valve solenoid actuator on a valve orifice via a valve seal, said actuator pushing on said plate by means of an elastic connection in particular formed of a spring for maintaining closure and a stop pin.

DESCRIPTION OF THE INVENTION

The forced recirculation mixer 1 according to the present invention, various details of its components, its variants, and its accessories are shown in FIGS. 1 to 6.

As is clear from FIG. 2, the forced recirculation mixer 1 is provided for mixing at least one vaporizable liquid 2 with at least one gas 3 to be mixed so as to form a homogeneous gas mixture 4.

It can be seen from FIGS. 1 to 4 and FIG. 6 that the forced recirculation mixer 1 according to the present invention comprises at least one stirring enclosure 5, the inner cavity of which forms a recirculation loop 6 in which the homogeneous gas mixture 4 can continuously circulate, the beginning and the end of the recirculation loop 6 being combined.

FIGS. 1 to 4 and FIG. 6 further show that the forced recirculation mixer 1 comprises at least one gas inlet duct 7 which emerges directly or indirectly into the stirring enclosure 5, and through which the gas 3 to be mixed is introduced into the recirculation loop 6 by means 8 for the introduction of gas in a known quantity, which may, for example, consist of a compressor 18 or a pressurized gas tank associated with a gas mass flowmeter 46 as shown in FIG. 1, these devices 18, 46 being known to the skilled person.

It is to be noted in FIGS. 1 to 4 and in FIG. 6 that the forced recirculation mixer 1 according to the present invention also comprises at least one liquid injection nozzle 9 which emerges directly or indirectly into the stirring enclosure 5 for introducing the vaporizable liquid 2 into the recirculation loop 6, said nozzle 9 being fed by means 10 for the introduction of liquid in a controlled quantity, the flow rate of vaporizable liquid 2 of which is controlled by a computer 45, said vaporizable liquid 2 forming, with the gas 3 to be mixed, the homogeneous gas mixture 4.

It is to be noted that the liquid injection nozzle 9 may be an integral part of the means 10 for the introduction of liquid in a controlled quantity, the latter possibly consisting for example of an electromagnetic, piezoelectric or electro-hydraulic-controlled injector, known per se, or a pump injector whose piston or pump diaphragm is actuated by a solenoid or a piezoelectric battery and whose injected quantity of vaporizable liquid 2 per unit of time is reasonably controllable.

In FIGS. 1 to 6 it has also been shown that the forced recirculation mixer 1 according to the present invention comprises at least one mixture draw-off duct 11 which emerges directly or indirectly into the stirring enclosure 5 and through which can be drawn-off the homogeneous gas mixture 4 from the recirculation loop 6 by gas drawing-off means 12 which may for example consist of a stratification injector 20 supplying pilot charge 55 to a valve-controlled ignition pre-chamber 21 as described in patent FR 3,061,743 belonging to the applicant.

As shown in FIGS. 1, 2 and 6, the forced recirculation mixer 1 according to the invention comprises at least one stirring turbine 13 which is set in motion by a turbine motor 28 and is positioned in the recirculation loop 6, said turbine 13 forcing the homogeneous gaseous mixture 4 to circulate in said loop 6.

It is to be noted that, as shown in FIGS. 1, 2 and 6, the turbine motor 28 can be an electric motor. As a variant, said motor 28 may be pneumatic, hydraulic, thermal or of any type known to the skilled person, whether said motor 28 is directly connected to the stirring turbine 13 to set it in motion, or indirectly connected to said turbine 13 by any type of transmission.

As shown in FIGS. 1, 2 and 6, the stirring enclosure 5 may include at least one external coaxial duct 14, of which each end is closed by a reversing terminating end 15, at least one internal coaxial duct 16 being accommodated in the external coaxial duct 14 and a gap being left for the homogeneous gas mixture 4 to circulate, on the one hand, between each reversing terminating end 15 and the internal coaxial duct 16 and, one the other hand, between the inner face of the external coaxial duct 14 and the outer face of the internal coaxial duct 16, the direction of circulation of the homogeneous gaseous mixture 4 in the external coaxial duct 14 being opposite to the direction of circulation of said mixture 4 in the internal coaxial duct 16.

It can also be seen in FIGS. 1, 2 and 6 that the stirring turbine 13 can be wholly or partly accommodated in one of the reversing terminating ends 15, the homogeneous gas mixture 4 being in this case sucked through the center of said turbine 13 via the internal coaxial duct 16 before being discharged at the periphery of said turbine 13 via the gap left between the inner face of the external coaxial duct 14 and the outer face of the internal coaxial duct 16.

FIGS. 1, 2 and 6 also show that the reversing terminating end 15 that accommodates the stirring turbine 13 may have a hollow hemi-toroidal shape, wherein blades 17 that comprise the stirring turbine 13 have a complementary projecting hemi-toroidal shape, with a small play left between said terminating end 15 and said blades 17.

As an alternative embodiment of the forced recirculation mixer 1 according to the invention shown in FIGS. 1 to 4 and in FIG. 6, the gas inlet duct 7 may pass through one of the reversing terminating ends 15 to emerge into the internal coaxial duct 16.

In this case, the reversing terminating end 15 through which the gas inlet duct 7 passes may have a hollow hemi-toroidal shape from which said duct 7 emerges.

In FIGS. 1 to 4 and in FIG. 6, it will be noted that advantageously the liquid injection nozzle 9 can emerge into the interior of the gas inlet duct 7, or at the outlet thereof. It should also be noted in said figures that to promote vaporization of the vaporizable liquid 2, the gas inlet duct 7 and/or the internal coaxial duct 16 can take the form of a Venturi tube.

As shown in FIGS. 1 to 4 and FIG. 6, the internal coaxial duct 16 can be held fixed in position in the external coaxial duct 14 by at least one stirring blade 22 which radially connects said internal coaxial duct 16 to said external coaxial duct 14.

It is also to be noted that, as shown in FIGS. 1 to 4 and in FIG. 6, the stirring blade 22 can advantageously be designed to create turbulence and differences in speed or advance in the flow of homogeneous gas mixture 4, so as to promote the homogeneity of the latter.

FIGS. 1 to 4 and FIG. 6 illustrate that according to a particular embodiment of the forced recirculation mixer 1 according to the present invention, the external coaxial duct 14 or any of its reversing terminating ends 15 may wholly or partly be surrounded by a draw-off ring 23, the interior of the latter being connected to the inside of the external coaxial duct 14 by at least one radial draw-off orifice 24, the mixture draw-off duct 11 being connected to the stirring enclosure 5 via said ring 23 and said orifice 24.

As can be seen in FIGS. 1 to 4 and FIG. 6, the shape and/or position of the radial draw-off orifice 24 may be provided to disturb as little as possible the flow of the gas 3 to be mixed in the external coaxial duct 14. In this respect, for example, the radial orifice 24 may form a bailer which emerges into the draw-off ring 23, the exit of the bailer requiring the drawn-off gas 3 that has to be mixed to turn around when it passes through orifice 24.

In FIGS. 1 to 4 and FIG. 6, it has also been shown that the stirring enclosure 5 may include heating or cooling means 25 which may, for example, consist of a thermal control chamber 26 as shown in those figures, said control chamber surrounding all or part of said enclosure 5; a heat-transfer or refrigerant gas or liquid 27 circulates in said chamber 26.

As an alternative shown in FIG. 7, the heating or cooling means 25 may consist of at least one electrical heating resistance 62, or any other means known to the skilled person to bring heat to the stirring enclosure 5 or to remove heat from this enclosure.

FIGS. 1, 2 and 6 show that the turbine motor 28 can be an electric motor 29 comprising, on the one hand, a rotor 30 which is rotationally connected to the stirring turbine 13 and which is enclosed in the stirring enclosure 5, and, on the other hand, a stator 31 which is placed outside said enclosure 5, wherein magnetic fields produced by said stator 31 can pass through the wall of the stirring enclosure 5 so as to put the rotor 30 in rotation.

It is to be noted that according to this particular configuration of the forced recirculation mixer 1 according to the present invention, the wall of the stirring enclosure 5 can be advantageously made of non-magnetic material such as stainless steel, aluminum, or brass.

FIG. 1 and FIGS. 3 to 6 show that the means 10 for the introduction of liquid in a controlled quantity may consist of a liquid piston pump 32 which includes a pump casing 42, said pump 32 also including at least one single-acting or double-acting pump piston 33 which, by the action of a piston actuator 34 cooperating with displacement control means 44, may move in translation in a pump cylinder 35 to form at least one pump chamber 36 of variable volume into which vaporizable liquid 2 may be introduced via an inlet valve 37, and from which said liquid 2 may be expelled to the liquid injection nozzle 9 via a discharge valve 38.

It will be noted that the displacement control means 44 may, for example, be constituted by an angular or linear, optical or "Hall effect", absolute or incremental encoder, or be constituted by the step-by-step driving of one or more linear or rotary electric motors, said control means 44 making it possible, in any case, a computer 45 to drive the position and the advancement speed of the pump piston 33 in the pump cylinder 35 and thus, to control the amount of vaporizable liquid 2 introduced into the recirculation loop 6 per unit of time.

It will also be noted that the pump piston 33 may comprise a piston seal 19 made, for example, of elastomer, said seal 19 may be simple, or composite and constituted of an O-ring that cooperates with a ring made of PTFE charged with anti-abrasive and/or anti-friction particles.

It is to be noted in FIG. 1 and in FIGS. 3 to 6 that the piston actuator 34 can be constituted by a actuator rotary electric motor 39 attached to the pump casing 42, said motor 39 being capable to rotate indifferently in one direction or in the opposite direction in order to drive in rotation driving transmission means 40 which are integral in translation with the pump casing 42 and which cooperate with driven transmission means 41 which are integral in translation with the pump piston 33, said driving transmission means 40 reacting with said casing 42 to move said driven transmission means 41 in longitudinal translation.

It will also be noted that the driving transmission means 40 may for example consist of a wheel which is tapped at its center and which is connected to the actuator rotary electric motor 39 by means of a reducer formed by a series of pinions, an epicyclic train, a succession of toothed pulleys and toothed belts, or any other type of reduction gear known to those skilled in the art, said wheel cooperating with a threaded rod which is integral in translation with the pump piston 33 and which forms the driven transmission means 41.

It will also be noted that the driving transmission means 40 and the driven transmission means 41 can be replaced by any other mechanism producing an equivalent or similar effect such as a rack and pinion gear device, or a pulley and cable device.

As shown in FIGS. 1, 3, 4 and 6 and according to a particular embodiment of the forced recirculation mixer 1 according to the invention, the driving transmission means 40 may be formed by a worm 47 which rotates a worm wheel 43 which has a wheel thread 56, the driven transmission means 41 consisting of a piston thread 57 which cooperates with the wheel thread 56.

As shown in FIG. 1, a gas mass flowmeter 46 can measure, directly or indirectly, the mass flow rate of the gas 3 to be mixed circulating in the gas inlet duct 7 and/or the mass flow rate of the homogeneous gas mixture 4 circulating in the mixture draw-off duct 11, said flowmeter 46 enabling the computer 16 to determine the mass flow rate of the vaporizable liquid 2 to be introduced into the stirring enclosure 5 by the liquid injection nozzle 9 to form in that enclosure 5 an homogeneous gaseous mixture 4 composed, in the desired proportions, of vaporizable liquid 2 and gas 3 to be mixed.

Once the mass flow rate of the vaporizable liquid 2 to be introduced into the stirring enclosure 5 is determined, the computer 16 can control the means 10 for the introduction of liquid in a controlled quantity so that it delivers to the liquid injection nozzle 9 the mass flow of vaporizable liquid 2 necessary for the formation of the desired homogeneous gas mixture 4 in the stirring enclosure 5.

FIGS. 7 to 9 show that the means 10 for the introduction of liquid in a controlled quantity may consist of an impulse pump 63 which includes a single-acting or double-acting impulse pump piston 64 and which, by the action of a pump solenoid actuator 65, is displaceable in translation in an impulse pump cylinder 67.

In this case, the impulse pump piston 64 may form with the impulse pump cylinder 67 at least one impulse pump chamber 68 of variable volume into which vaporizable liquid 2 may be introduced via an impulse pump inlet valve 69, and from which said liquid 2 may be expelled to the liquid injection nozzle 9 via an impulse pump discharge valve 70.

In FIGS. 7 to 9, it has also been shown that the volume and/or mass flow rate of vaporizable liquid 2 can be sent back to the computer 45 by a vaporizable liquid flowmeter 71 placed upstream or downstream of the means 10 for the introduction of liquid in a controlled quantity.

According to this particular configuration of the forced recirculation mixer 1 of the invention, the vaporizable liquid flowmeter 71 may be constituted by a flowmeter piston 72 which can move in a sealed manner in a flowmeter cylinder 73 so as to form a flowmeter upstream chamber 75 which is directly or indirectly connected to a pressure source 77; the latter may be constituted by the fuel pump 53 of an internal combustion engine 51 which in parallel feeds the injectors known per se of said engine 51.

In this case, the flowmeter piston 72 also forms with the flowmeter cylinder 73 a flowmeter downstream chamber 76 which is directly or indirectly connected to the liquid injection nozzle 9.

Still according to this particular configuration of the forced recirculation mixer 1 of the invention, the position of the flowmeter piston 72 in the flowmeter cylinder 73 is transmitted to the computer 45 by a position sensor 74 which may be inductive, capacitive, optical, or of any type known to those skilled in the art, a flowmeter piston return spring 78 tending to push the flowmeter piston 72 toward the flowmeter upstream chamber 75.

As can be seen clearly in FIGS. 7 and 10, the flowmeter upstream chamber 75 can be connected with the flowmeter downstream chamber 76 by a flowmeter piston return valve 72.

In this case, vaporizable liquid 2 is transferred from the flowmeter upstream chamber 75 to the flowmeter downstream chamber 76, this transfer resulting from the force exerted by the flowmeter piston return spring 78 on the piston flowmeter 72 which has the effect of moving the latter in the direction of the flowmeter upstream chamber 75.

It is to be noted that the flowmeter piston return valve 72 may be of the "normally open" type as shown in FIGS. 7, 9 and 10, or otherwise of the "normally closed" type.

FIG. 10 shows a particular embodiment of the flowmeter piston return valve 72 of the forced recirculation mixer 1 of the invention, according to which said valve 72 comprises an orientable sealing plate 85 which can be held pressed on a valve orifice 86 by a valve solenoid actuator 88, a valve seal 87 being interposed between said plate 85 and said orifice 86, and the valve solenoid actuator 88 pushing on the orientable sealing plate 85 by means of an elastic connection 89.

As another variant embodiment of the forced recirculation mixer 1 according to the present invention, it has been shown in FIGS. 7 to 9 that a nozzle accumulator 80 can be interposed between the means 10 for the introduction of liquid in a controlled quantity and the liquid injection nozzle 9 so that if said means 10 produces large variations in the flow rate of vaporizable liquid 2, the effective flow rate of said liquid 2 expelled by the liquid injection nozzle 9 into the stirring enclosure 5 being subjected to said variations over a smaller amplitude.

In this case, the nozzle accumulator 80 may comprise a nozzle accumulator piston 81 which, together with an accumulator cylinder 82, forms an accumulator chamber 83, said piston 81 being pushed in the direction of said chamber 83 by an accumulator spring 84, the liquid injection nozzle 9 being integral with said piston 81 and passing right through the latter in the lengthwise direction thereof.

Operation of the Invention

The operation of the forced recirculation mixer 1 according to the present invention is easily understood in view of FIGS. 1 to 6.

To illustrate this operation, let us suppose here that, as shown schematically in FIG. 1, the forced recirculation mixer 1 is used to supply with a homogeneous gas mixture 4 a stratification injector 20 for a valve-controlled ignition pre-chamber as described in the patent FR 3,061,743, said pre-chamber 21 being applied to an internal combustion engine 51 used to power an automobile, not shown.

As can be seen in FIGS. 1 and 7, the forced recirculation mixer 1 according to the present invention advantageously replaces a carburetor or injector which would be placed at the inlet of compressor 18. In relation to such a configuration, said mixer 1 eliminates any risk of self-ignition of the homogeneous gaseous mixture 4 in said compressor 18, and any risk of re-condensation inside said compressor 18 of the vaporizable liquid 2 which partly constitutes said mixture 4.

In addition, and compared to a carburetor or injector placed at the inlet of the compressor 18, the forced recirculation mixer 1 according to the invention prepares a homogeneous gaseous mixture 4 of more precise composition, of greater homogeneity, and potentially reduces the quantity of homogeneous gaseous mixture 4 stored between the inlet of the compressor 18 and the stratification injector 20.

The mixer 1 according to the present invention also ensures permanent mixing of the homogeneous gas mixture 4 even when the internal combustion engine 51 is momentarily stopped, which is desirable, for example, in the context of thermal-electric hybrid applications such as found in automobiles.

As such, the forced recirculation mixer 1 according to the present invention provides a greater freedom in the technical definition of the compressor 18 than a carburetor or injector placed at the inlet of said compressor 18.

The fact remains that a carburetor or injector remains a possible solution for implementing the valve-controlled ignition pre-chamber 21 on any internal combustion engine 51, in particular if said engine is fitted to a mass-produced automobile.

In the context of the particular application of the forced recirculation mixer 1 according to the invention disclosed herein, the homogeneous gas mixture 4 constitutes the pilot charge 55 introduced by the stratification injector 20 in the valve-controlled ignition pre-chamber 21 on each cycle of the internal combustion engine 51.

According to this particular example of the use of the forced recirculation mixer 1 of the invention, the stratification injector 20 and the valve-controlled ignition pre-chamber 21 thus form gas draw-off means 12.

We will assume here that the gas 3 to be mixed is atmospheric air 49 while the vaporizable liquid 2 is gasoline 50 as commonly consumed by automobiles.

Let us also suppose here that the homogeneous gas mixture 4 which feeds the stratification injector 20 must be composed, as a non-limitative example, of fourteen grams of air 49 per gram of gasoline 50, said gas mixture 4 being therefore slightly rich compared to stoichiometry.

Let us consider that in this particular application of the forced recirculation mixer 1 according to the invention, the mass flow of homogeneous gas mixture 4 to be supplied to the stratification injector 20 when the internal combustion engine 51 is idling is one hundred and fifty times lower than the mass flow of said mixture 4 to be supplied to said injector 20 when said engine 51 is operating at full power.

Let us consider here that whatever the operating point of the internal combustion engine 51, the mass proportion of air 49 and gasoline 50 of which the homogeneous gaseous mixture 4 is constituted must not vary.

Let us also assume that the homogeneous gas mixture 4 consisting of air 49 and gasoline 50 is supplied to the stratification injector 20 under a pressure of forty bars.

To achieve this result, we note in FIG. 1 that the air 49 is pressurized by the compressor 18 which is represented symbolically. Said compressor 18 cooperates with a gas mass flowmeter 46. Together, said compressor 18 and said flowmeter 46 form the means 8 for the introduction of gas in a known quantity which the forced recirculation mixer 1 according to the present invention comprises.

As a non-limiting example of an embodiment of said mixer 1, FIG. 1 and FIGS. 3 to 6 show that gasoline 50 is pressurized by a liquid piston pump 32 which includes a double-acting pump piston 33 which can move in translation in a pump cylinder 35 to form two pump chambers 36 of variable volume.

In FIGS. 3 and 4, arrows show that gasoline 50 is introduced into each of the pump chambers 36 via an intake valve 37, said gasoline 50 then being expelled to the liquid injection nozzle 9 via a discharge valve 38.

Thus constituted, the liquid piston pump 32 forms the means 10 for the introduction of liquid in a controlled quantity.

It is to be noted in FIG. 1 that gasoline 50 comes from a gasoline tank 52 that includes the automobile powered by the internal combustion engine 51. It is also to be noted in FIG. 1 that, prior to its introduction into the liquid piston pump 32, the gasoline 50 is pressurized by a gasoline pump 53 which also has to supply a main injection system (not shown) that comprises said engine 51.

To achieve a homogeneous gas mixture 4 in the proportion of fourteen grams of air 49 per gram of gasoline 50 under a pressure of forty bars, the stirring enclosure 5 in which said mixture 4 is produced must be carried at a temperature of at least seventy degrees Celsius.

Said temperature is necessary so that all of the gasoline 50 which forms the homogeneous gas mixture 4 passes to the vapor state and remains in said state, taking into account the saturated vapor pressure of said gasoline 50 at said temperature.

This is why, as shown in FIGS. 1 to 4 and FIG. 6, is provided a thermal control chamber 26 which surrounds a large part of the stirring enclosure 5. A heat-transferring or refrigerant liquid or gas 27, that consists of cooling water 54 for cooling the internal combustion engine 51, circulates in the thermal control chamber 26. Said water 54 circulating in the thermal control chamber 26 at a temperature close to one hundred degrees Celsius is symbolized in FIG. 2 by the letter "C".

Thus, the thermal control chamber 26 is a heating or cooling means 25 which ensures that gasoline 50, from which the homogeneous gas mixture 4 is formed in part, remains entirely vapor, this despite the pressure of forty bars to which said mixture 4 is subjected.

When the internal combustion engine 51 is idling, the total quantity of homogeneous gaseous mixture 4 introduced each second into the valve-controlled ignition pre-chamber 21 by the stratification injector 20 is very small. As an order of magnitude, said amount may be twenty-two normalized cubic centimeters of air 49 mixed with two point five cubic millimeters of gasoline 50.

Also, to obtain a homogeneous mixture of air 49 and gasoline 50, the homogeneous gas mixture 4 is stirred in the recirculation loop 6 formed by the internal cavity of the stirring enclosure 5.

Let us assume here that the stirring enclosure 5 contains sixty cubic centimeters of homogeneous gaseous mixture 4 subjected to a pressure of forty bars. This quantity of said mixture 4 is that which is supplied each minute by the stratification injector 20 to the valve-controlled ignition pre-chamber 21 in the form of pilot charges 55 when the internal combustion engine 51 is operating at idle.

When the internal combustion engine 51 is idling, the mass flow rate of homogeneous gaseous mixture 4 circulating in the recirculation loop 6 is thus several tens to several hundreds of times greater than the flow rate of said mixture 4 drawn-off from the stirring enclosure 5 by the stratification injector 20 to supply the valve-controlled ignition pre-chamber 21.

The current flow of homogeneous gaseous mixture 4 contained in the stirring enclosure 5 and the stirring of said mixture 4 produced by its incessant displacement in the recirculation loop 6 allows to average the composition of said mixture 4 over a long period of time, and making said mixture 4 highly homogeneous.

The stirring of the homogeneous gas mixture 4 is particularly shown in FIG. 2, on which it can be seen that the recirculation loop 6 is formed of an external coaxial duct 14, each end of which is closed by a reversing terminating end 15 of hollow hemi-toroidal shape, and an internal coaxial duct 16 is accommodated in the external coaxial duct 14; a gap is left for the homogeneous gas mixture 4 to circulate, on the one hand, between each reversing terminating end 15 and the coaxial duct internal 16 and, on the other hand, between the inner face of the external coaxial duct 14 and the outer face of the internal coaxial duct 16.

It is to be noted in FIG. 2 that the direction of circulation of the homogeneous gas mixture 4 in the external coaxial duct 14 is opposite to the direction of circulation of said mixture 4 in the internal coaxial duct 16.

In FIGS. 1, 2 and 6, there is shown the stirring turbine 13 which is partly accommodated in one of the reversing terminating ends 15, the homogeneous gas mixture 4 being sucked by the center of said turbine 13 via the internal coaxial duct 16 as shown particularly clearly by the arrows shown in FIG. 2, this before being discharged to the periphery of said turbine 13 via the gap left between the internal face of the external coaxial duct 14 and the external face of the internal coaxial duct 16.

In FIGS. 1, 2 and 6, it has been shown that advantageously and according to this exemplary embodiment of the forced recirculation mixer 1 of the invention, the hollow hemitoroidal shape of the reversing terminating end 15 which accommodates the stirring turbine 13 is complementary to that of the projecting blades 17 that includes said turbine 13, a small play being left between said terminating end 15 and said blades 17.

It is to be noted in FIG. 1 that the turbine motor 28 which rotates the stirring turbine 13 is an electric motor 29 which comprises, on the one hand, a rotor 30 which is connected in rotation to the stirring turbine 13 and which is enclosed in the turbine enclosure 5, and, on the other hand, a stator 31 which is placed outside said enclosure 5, rotating magnetic fields produced by said stator 31 passing through the wall of the stirring enclosure 5 to put the rotor 30 in rotation.

This particular configuration of the turbine motor 28 avoids the use of a rotating shaft sealing passing through the wall of the stirring enclosure 5 to ensure the rotation drive of the stirring turbine 13, this being advantageous in view of the relatively high pressure of forty bars prevailing in said enclosure 5.

FIGS. 1 to 4 and 6 show that, in order to emerge in the internal coaxial duct 16, the gas inlet duct 7 passes through the reversing terminating end 15 which is opposite to the one accommodating the stirring turbine 13.

As can be clearly seen in FIGS. 1, 2 and 6, the internal coaxial duct 16 is held in position in the external coaxial duct 14 by stirring vanes 22 that radially connect the internal coaxial duct 16 to said external coaxial duct 14. Advantageously, the stirring vanes 22 create turbulence and differences in speed in the flow of homogeneous gas mixture 4, and promote the homogeneity of the latter.

As can be seen in FIG. 2, the gas 3 to be mixed, consisting here of air 49 symbolized by the letter "A", is introduced into the stirring enclosure 5 through the gas inlet duct 7, and the liquid injection nozzle 9 emerges inside said duct 7 in the vicinity of the outlet of the latter into the stirring enclosure 5.

The liquid injection nozzle 9 introduces into the air 49 circulating in the gas intake conduit 7 the necessary quantity of vaporizable liquid 2 constituted here by gasoline 50 symbolized by the letter "F", so that a more or less homogeneous gaseous mixture 4 is formed, containing more or less gasoline 50 in the liquid state, this in the proportion of fourteen grams of air 49 per gram of gasoline 50.

Thus, the air 49 is pre-mixed with the gasoline 50, part of which evaporates in the gas inlet duct 7, and the resulting gas mixture then flows into the stirring enclosure 5.

The premixture of air 49 and gasoline 50 is then set in motion in the recirculation loop 6 by the homogeneous gas mixture 4 already circulating there. Said premixture is then stirred in particular by the stirring turbine 13 and by the stirring blades 22, the gasoline 50 which constitutes said premixture evaporating entirely to form the desired homogeneous gas mixture 4.

It should be noted that if some of the gasoline 50 leaves the gas inlet duct 7 in the liquid state, it will inevitably be deposited on the surface of the blades 17 of the stirring turbine 13, on the inner or outer face of the internal coaxial duct 16, on the inner face of the external coaxial duct 14, or on the surface of the stirring blades 22. Then, the forced circulation of the homogeneous gas mixture 4 in the recirculation loop 6 will dry said surfaces which carry said gasoline 50 in the liquid state, so that said gasoline 50 joins said gas mixture 4 in the vapor state.

As shown in FIG. 2, the extraction of the homogeneous gas mixture 4 consisting of air 49 and gasoline 50 symbolized in said FIG. 2 by the letters "AF" takes place via the mixture draw-off duct 11 which emerges in the stirring enclosure 5 and more precisely, in the recirculation loop 6 formed by the internal cavity of the stirring enclosure 5.

It is to be noted in FIGS. 1 to 5 and in FIG. 6 that the upper reversing terminating end 15 of the external coaxial duct 14 is partly surrounded by a draw-off ring 23 whose interior is connected to the interior of the external coaxial duct 14 by radial draw-off orifices 24, the mixture draw-off duct 11 being connected to the stirring enclosure 5 by means of said ring 23 and said orifices 24.

As can be seen in FIGS. 1 to 4 and in FIG. 6, the position and orientation of the radial draw-off orifices 24 are provided to disturb as little as possible the flow of the homogeneous gas mixture 4 in the external coaxial duct 14 and more precisely, in the upper reversing terminating end 15 of the external coaxial duct 14.

Thus, when the homogeneous gas mixture 4 is drawn-off from the stirring enclosure 5 by the stratification injector 20, said mixture 4 is perfectly homogeneous, and consists exclusively of air 49 and gasoline 50 in proportion to fourteen grams of air 49 per gram of gasoline 50.

To obtain precisely such a proportion of air 49 and gasoline 50, it is necessary to know the mass flow of air 49 admitted into the stirring enclosure 5, in order to be capable to introduce into said air 49 the right quantity of gasoline 50 via the liquid injection nozzle 9.

For this reason, the forced recirculation mixer 1 of the invention cooperates, according to the embodiment described here to illustrate its operation, with a mass flowmeter of gas 46 which can be depressogenic, pitot tube, ludion, with cup, propeller or turbine, with pallet, ionic, ultrasonic, electromagnetic, Coriolis, Karman tourbillon or vortex effect, with hot wire or film, thermal mass, or in general, of any type known to the skilled person.

Said flowmeter 46 returns the effective mass flow rate of air 49 allowed in the stirring enclosure 5 to the computer 45, which is symbolized in FIG. 1 by the letters "ECU", said the computer 45 being capable to control the liquid piston pump 32 accordingly.

As shown in FIGS. 1, 3, 4 and 6, the double-acting piston pump 33 of the piston pump 32 is here moved in translation into the pump cylinder 35 with which it cooperates by an actuator rotary electric motor 39 attached to the pump casing 42.

As shown in FIGS. 3 and 4, the actuator electric rotary motor 39 can rotate in one direction or the other to drive in rotation driving means 40 which are connected in translation to the pump casing 42 and which are formed here by a worm 47 which rotates a worm wheel 43 provided with a wheel thread 56.

As can be clearly seen in FIGS. 3 and 4, the wheel thread 56 cooperates with a piston thread 57 which is integral with the pump piston 33 and forms a driven transmission means 41.

As the worm wheel 43 rotates by the action of the worm 47, it screws or unscrews the female wheel thread 56 around the male piston thread 57, thereby moving the double-acting pump piston 33 translationally in the pump cylinder 35.

FIG. 3 shows that as the actuator rotary electric motor 39 rotates the worm 47 clockwise, the pump piston 33 moves downward and expels gasoline 50 contained in the lower pump chamber 36 out of the pump chamber 36 via the discharge valve 38 thereof, while the upper pump chamber 36 draws in gasoline 50 via its inlet valve 37.

FIG. 4 shows what happens when the actuator rotary electric motor 39 rotates the worm 47 counterclockwise. In this case, the pump piston 33 rises and expels the gasoline 50 contained in the upper pump chamber 36 out of said chamber 36 via the discharge valve 38 of the latter, while the lower pump chamber 36 sucks gasoline 50 via its intake valve 37.

It is to be noted in FIG. 6 that the piston thread 57 is locked in rotation in the pump casing 42 by a hexagonal head 58 which cooperates with a complementary extrusion form provided in said casing 42.

It is also to be noted in FIGS. 1, 3, 4 and 6 that while rotating around its longitudinal axis, the worm wheel 43 is axially supported in the pump casing 42 by means of ball stops 59 known per se.

Finally, it can be noted in FIGS. 1, 3, 4 and 6 that any axial play between the worm wheel 43 and the pump casing 42 is eliminated by an axial play removing spring 60 which, according to this example, is interposed between said casing 42 and the upper ball stop 59.

In FIG. 1 and in FIGS. 3 to 6, the actuator rotary electric motor 39 is shown, being here and according to this example a brushless motor 39 which incorporates a "Hall effect" encoder generating thirty pulses per turn of said motor 39.

It is to be noted, particularly in FIGS. 1, 3, 4 and 6, that the inside of the pump cylinder 35 has an initialization stop 61 which the pump piston 33 can contact so that the computer 45 can count the pulses generated by the "Hall effect" encoder from this reference.

Thus, if the worm wheel 43 has thirty teeth, if the pitch of the wheel thread 56 and the piston thread 57 is one millimeter, and taking into account the thirty pulses generated by the "Hall Effect" encoder at each turn of the actuator rotary electric motor 39, a pulse of the "Hall Effect" encoder corresponds to a displacement of the pump piston 33 of approximately one micrometer.

As the ratio between the displacement of pump piston 33 and the amount of gasoline 50 expelled from the corresponding pump chamber 36 is known from computer 45, the latter can precisely control the rotation of the actuator rotary electric motor 39 so as to generate a mass flow of gasoline 50 to be expelled via the liquid injection nozzle 9 worth one fourteenth of the mass flow of air 49 sent back to said computer 45 by the gas mass flowmeter 46.

As can be easily inferred from the above, the forced recirculation mixer 1 according to the present invention makes it possible to produce a homogeneous gas mixture 4 formed here of air 49 and gasoline 50 in proportion to fourteen grams of air 49 per gram of gasoline 50.

For this, the forced recirculation mixer 1 does not require a high-pressure gasoline pump, the pressure of a few bars usually supplied by the gasoline pumps 53 fitted to the most widespread multipoint injection systems in the automotive industry is, for example, sufficient to supply the liquid piston pump 32. Indeed, it is the liquid piston pump 32 itself which is in charge of raising the pressure of the gasoline 50 to more than forty bars necessary for the introduction of said gasoline 50 in the stirring enclosure 5 via the liquid injection nozzle 9.

To achieve the desired result, the forced recirculation mixer 1 according to the invention also does not require a high-precision injector whose injected quantity remains uncertain in all cases, particularly at very low flow rates. It should also be noted that the particular configuration of the forced recirculation mixer 1 does not require atomizing the gasoline 50 in fine droplets to ensure the entire vaporization. In fact, this vaporization can be carried out a posteriori in the recirculation loop 6, without damage to the average content of gasoline 50 of the homogeneous gas mixture 4.

As can be inferred from the figures and from the present description of operation of the forced recirculation mixer 1, the liquid piston pump 32 simultaneously ensures the injection and the measurement of the flow rate of the gasoline 50 introduced into the stirring chamber 5 via the liquid injection nozzle 9. Said liquid piston pump 32 therefore avoids having to use a gasoline flowmeter 50 to form the homogeneous gas mixture 4 in due proportion of air 49 and gasoline 50.

It can be seen that if the diameter of the pump piston 33 is twelve millimeters, this with a worm wheel 43 of thirty teeth, a wheel thread pitch 56 and a piston thread pitch 57 of one millimeter, and with thirty pulses generated by the "Hall effect" encoder with each revolution of the actuator rotary electric motor 39, one pulse of the "Hall effect" encoder corresponds to approximately zero point eight milligrams of gasoline 50 injected into the stirring enclosure 5 via the liquid injection nozzle 9.

If the pitch of the wheel thread 56 is halved, the amount of gasoline 50 injected per pulse of the "Hall effect" encoder is twice as small.

It should be noted that, to the total number of pulses generated by the "Hall effect" encoder over the entire stroke of the pump piston 33, thus corresponds a certain quantity of gasoline 50, determined with great precision.

As a result, the accuracy of the amount of gasoline 50 introduced into the stirring enclosure 5 via the liquid injection nozzle 9 between two pulses of the "Hall effect" encoder is on average very high.

Since the stirring enclosure 5 dilutes said quantity of gasoline 50 in a large quantity of homogeneous gas mixture 4 over a relatively long time, the richness of the homogeneous gas mixture 4 drawn off by the stratification injector 20 is very precise, which favors control in all circumstances of the operation of the valve-controlled ignition pre-chamber 21 according to patent FR 3,061,743.

It is to be noted that since the pump piston 33 is double-acting, its maximum forward speed may, for example if its diameter is twelve millimeters, not exceed three or four millimeters per second to supply the valve-controlled ignition pre-chambers 21 of a supercharged internal combustion engine 51 of two liters of cylinder capacity operating at maximum power.

This millimeter speed makes it possible to equip said piston 33 with a perfectly sealed piston seal 19, the service life of which will be long despite it operates in gasoline 50 which has no particular lubricating properties.

Indeed, the piston seal 19 may for example be composite and include a ring made of PTFE charged with anti-friction particles, said ring being held in contact with the pump cylinder 35. Such a piston seal 19 is particularly suited to the operating conditions which have just been described and can last at least as long as the internal combustion engine 51 of which it cooperates in supplying the valve-controlled ignition pre-chamber 21 with a homogeneous gas mixture 4 via the stratification injector 20.

It is to be noted that according to the exemplary embodiment of the forced recirculation mixer 1 of the invention which has just been described, the computer 45 advantageously compensates for the losses of average flow rate of gasoline 50 during changes in direction of the double-acting piston pump 33 in the pump cylinder 35.

Indeed, at the reversing point of said piston 33, the actuator rotary electric motor 39 must compensate some play such as the one between the worm 47 and the worm wheel 43, or to compensate for the deformation of the piston seal 19 in its groove when changing the direction of the pressure difference to which the seal 19 is subjected.

The computer 45 can make this compensation by measuring the electrical current required by the actuator rotary electric motor 39 to move, such intensity making it possible to detect when the pump piston 33 again faces a pressure of at least forty bars.

The computer 45 can also incorporate data on the necessary compensation at the reversing point of the pump piston 33, which data resulting of bench tests carried out prior to the first use of the forced recirculation mixer 1 according to the invention.

Thus, taking into account the time allocated to the reloading operation of the pump piston 33, the computer 45 can reconstruct the average flow required to obtain the homogeneous gas mixture 4 according to the desired air ratio 49 to gasoline 50, bearing in mind that the richness temporary change as seen by the stratification injector 20 is negligible provided the current large amount of homogeneous gas mixture 4 contained in the stirring enclosure 5.

In FIGS. 7 to 10, an alternative embodiment of the forced recirculation mixer 1 according to the invention is shown, in which the means 10 for the introduction of liquid in a controlled quantity no longer consist of a liquid piston pump 32 as just described, but of an impulse pump 63 accommodated in a pump casing 42.

According to the example embodiment of the forced recirculation mixer 1 of the invention shown in FIGS. 7 to 9, the impulse pump 63 comprises a single-acting impulse pump piston 64 which, by the action of a pump solenoid actuator 65, is translatable in an impulse pump cylinder 67.

It will also be assumed here that the gas 3 to be mixed is atmospheric air 49 while the vaporizable liquid 2 is gasoline 50 as commonly consumed by automobiles.

The impulse pump piston 64 forms, together with the impulse pump cylinder 67, an impulse pump chamber 68 of variable volume into which the gasoline 50 can be introduced via an impulse pump inlet valve 69, and from which said gasoline 50 can be expelled to the liquid injection nozzle 9 via an impulse pump outlet valve 70.

It is to be noted that the impulse pump discharge valve 70 may be highly calibrated—to several bars—so that if the pressure which prevails in the stirring enclosure 5 is lower than that which prevails in the gasoline circuit 50 located upstream of the impulse pump 63, the stirring enclosure 5 does not fill up with gasoline 50 in an undesirable manner.

To inject gasoline 50 into the stirring enclosure 5, the computer 45 supplies the solenoid coil 95 of the pump solenoid actuator 65 with electric current. This has the effect of pushing back the impulse pump piston 64 in the direction of the impulse pump chamber 68, said piston 64 expelling the corresponding quantity of gasoline 50 out of said chamber 68 via the impulse pump discharge valve 70 and the liquid injection nozzle 9.

This done, the computer 45 stops supplying the solenoid coil 95 with electric current so that a pump piston return spring 66 returns the impulse pump piston 64 to bottom dead center and the impulse pump chamber 68 again draws in gasoline 50 via its impulse pump inlet valve 69.

It is to be noted that the pump piston return spring 66 is not necessary if the supply pressure of gasoline 50 which prevails upstream of the impulse pump inlet valve 69 is sufficient to push the impulse pump piston 64 back to bottom dead center within the allotted time.

FIGS. 7 to 9 show the presence of a nozzle accumulator 80 between the impulse pump 63 and the liquid injection nozzle 9.

The nozzle accumulator 80 makes it possible to provide a liquid injection nozzle 9 leaving only a small section to the passage of gasoline 50, which favors a fine atomization of said gasoline 50 at the outlet of said nozzle 9 in the stirring enclosure 5.

The nozzle accumulator 80 also makes it possible the pressure peaks occurring at the outlet of the impulse pump discharge valve 70 to be clipped, thus avoiding the oversizing of the solenoid coil 95 so as to counter these peaks.

In addition, the nozzle accumulator 80 reduces the range of variations of the gasoline flow rate 50 vaporized into the stirring enclosure 5 by the liquid injection nozzle 9 which conducts to a better homogeneity of the homogeneous gas mixture 4 formed in said enclosure 5.

According to the non-limitative example shown in FIGS. 7 to 8, the nozzle accumulator 80 comprises a nozzle accumulator piston 81 which forms, with an accumulator cylinder 82, an accumulator chamber 83, said piston 81 being pushed in the direction of said chamber 83 by an accumulator spring 84, the liquid injection nozzle 9 being integral with said piston 81 and passing right through the latter in the lengthwise direction thereof.

In FIGS. 8 and 9, it can be seen that means for adjusting the stroke of the solenoid 96 make it possible to adjust the effective stroke of the impulse pump piston 64 and therefore to adjust the cylinder capacity of the impulse pump 63.

It can easily be inferred from the above that the gasoline flow rate 50 injected into the stirring enclosure 5 by the impulse pump 63 is the product of the cylinder capacity of said pump 63 by its volumetric efficiency by its actuation frequency.

By way of example, if the cylinder capacity of said pump 63 is thirteen cubic millimeters, if the volumetric efficiency of said pump 63 is seventy percent, and its actuation frequency is thirty Hertz, then, the flow rate of said pump 63 is two hundred and seventy-three cubic millimeters per second.

For the computer 45 to adjust the effective flow rate of the impulse pump 63 necessary for the formation in the stirring enclosure 5 of the homogeneous gas mixture 4 according to the desired air 49 to gasoline 50 ratio, as can be seen in FIGS. 7 to 9, the forced recirculation mixer 1 comprises a vaporizable liquid flowmeter 71 which sends back to said computer 45 the effective mass flow of gasoline 50 injected by the liquid injection nozzle 9 into the stirring enclosure 5.

Thanks to the vaporizable liquid flowmeter 71, the computer implements a software control loop of the "PID controller" type, known per se.

Indeed, the gas mass flowmeter 46 sends back to the computer 45 the effective mass flow of air 49 entering the stirring enclosure 5, of which naturally results the setpoint of the flow of gasoline 50 to be introduced into said enclosure 5 by the impulse pump 63 taking into account the desired air 49 to gasoline 50 ratio.

The flow rate of the gasoline 50 thus forms the value set by the PID controller, said flow rate may oscillate more or less around the set value assigned to it provided that the effective value of said flow rate is close to that set value when averaged over a few seconds.

Indeed, the forced circulation by the stirring turbine 13 of the homogeneous gaseous mixture 4 in the stirring enclosure 5 homogenizes said mixture 4 despite variations in the flow rate of gasoline 50 around the set value.

To regulate up or down the flow rate of gasoline 50, the computer 45 can modulate the frequency and/or the activation power of the pump solenoid actuator 65 of the impulse pump 63.

According to the example of the non-limitative embodiment of the forced recirculation mixer 1 of the invention shown in FIGS. 7 to 9, the vaporized liquid flowmeter 71 notably includes a flowmeter piston 72 which can move in a sealed manner in a flowmeter cylinder 73 so as to form, on the one hand, a flowmeter upstream chamber 75 connected to the gasoline pump 53 of the engine 51, and on the other hand, a flowmeter downstream chamber 76 which is connected to the inlet of the impulse pump 63.

It is noted, particularly in FIGS. 7 and 8, that the flowmeter piston 72 has at each end a flowmeter piston sealed extender 101 emerging to the open air.

The flowmeter piston sealed extenders 101 ensure that for the same displacement of the flowmeter piston 72, the volume of gasoline 50 admitted or discharged by the flowmeter upstream chamber 75 is identical to that simultaneously admitted or discharged by the flowmeter downstream chamber 76. Thus, the flow rate of gasoline 50 delivered by the gasoline pump 53 is in no way disturbed by the back-and-forth movements of the flowmeter piston 72 in the flowmeter cylinder 73, regardless of the speed of said back-and-forth movements.

The position of the flowmeter piston 72 in the flowmeter cylinder 73 is transmitted to the computer 45 by a position sensor 74 which, in this case, is an absolute linear encoder as marketed by the "Posic" company.

The encoder reads a target strip 100 which is carried by a support-strip guided slider 97, which can be moved in longitudinal translation in a slider guide rail 98 in which it is accommodated with small play, on the one hand, and in the extension of the flowmeter piston 72, on the other hand.

It is to be noted that the support-strip guided slider 97 is secured in translation to the flowmeter piston 72 by a coupling magnet 99, the latter being permanently attracted by the flowmeter piston sealed extender 101 which is positioned on the side of the target strip 100.

In FIGS. 7 to 9, it can be seen that the flowmeter piston return spring 78 tends to move the flowmeter piston 72 in the direction of the flowmeter upstream chamber 75.

One can easily infer from the diagram of FIG. 7 the operating principle of the vaporizable liquid flowmeter 71.

In fact, to determine the mass flow of gasoline 50 introduced into the stirring enclosure 5 by the impulse pump 63, the computer 45, on the one hand and via the position sensor 74, retrieves the distance traveled per unit of time by the flowmeter piston 72, and, on the other hand, by means of a temperature sensor 103 placed at the flowmeter downstream chamber 76, the temperature of said gasoline 50.

For example, if the effective section of the flowmeter piston 72 is one hundred and forty square millimeters, when the latter moves one millimeter per second, the volume flow rate of gasoline 50 introduced into the stirring enclosure 5 by the impulse pump 63 is one hundred and forty cubic millimeters per second.

To calculate the mass flow of gasoline 50 introduced into the stirring enclosure 5, the density at twenty degrees Celsius and the thermal expansion coefficient of said gasoline 50 being known because they are entered by the computer (not shown) of the internal combustion engine 51, the computer 45 only has to multiply the density of said gasoline 50 by its volume flow rate.

For greater precision, a pressure sensor 102 may optionally be provided at the flowmeter downstream chamber 76, to allow the computer 45 to include the compressibility of the gasoline 50 into its density calculation of said gasoline. 50.

When the flowmeter piston 72 reaches the end of the reading stroke, that is to say when the volume of the flowmeter downstream chamber 76 reaches its predetermined minimum value, the flowmeter piston return valve 72 opens and connects said downstream chamber 76 with the flowmeter upstream chamber 75, which has the effect of transferring gasoline 50 contained in the flowmeter upstream chamber 75 into the flowmeter downstream chamber 76.

This gasoline transfer 50 results from the force exerted by the flowmeter piston return spring 78 on the flowmeter piston 72, said force having the effect of moving the latter towards the flowmeter upstream chamber 75.

During said transfer of gasoline 50, which may last about 100 milliseconds, the volume flow measurement of gasoline 50 is temporarily interrupted. However, the total measurement error is very small as the computer 45 can reconstitute the flow rate of gasoline 50 during the interruption of the measurement by averaging the flow rate of gasoline 50 recorded just before the opening of the flowmeter piston return valve 72 and that recorded immediately after the closing of said valve 72.

It should be noted that the return of the flowmeter piston 72 described above rarely occurs, for example every 10 minutes when the internal combustion engine 51 is idling, and every four seconds when said engine 51 is operating at full power.

It is to be noted that the flowmeter piston return valve 72 may be of the "normally open" type as shown in FIGS. 7, 9 and 10, so that when the engine 51 is stopped for a long time, the thermal expansion or contraction of the gasoline 50 contained in the circuits and internal volumes of the forced recirculation mixer 1 according to the invention can never result in untimely injections of gasoline 50 in the stirring enclosure 5 via the impulse pump 63 and the liquid injection nozzle 9.

In FIG. 10, the flowmeter piston return valve 72 has been shown in more detail, which valve includes an orientable sealing plate 85 that can be held pressed on a valve orifice 86, via a valve seal 87, by a valve solenoid actuator 88, the latter pushing on the orientable sealing plate 85 via an elastic connection 89 consisting of a closure-maintaining spring 93, the maximum length of which being limited by a stop pin 94.

In FIG. 7 are also shown some accessories relevant to the proper operation of the forced recirculation mixer 1 according to the invention for the implementation of the valve-controlled ignition pre-chamber 21 subject of the FR 3,061,743 patent, on a car internal combustion engine 51.

For example, the compressor outlet leak-proof check valve 90 is used to hold the stirring enclosure 5 under pressure when the internal combustion engine 51 is shut down for a time ranging from a few seconds to a few minutes, said valve 90 being useful when the discharge valves of compressor 18 are not perfectly sealed.

There is also the canister discharge solenoid valve 91 which makes it possible for the stirring enclosure 5 to be gradually depressurized when the internal combustion engine 51 is shut down and cools down. When said solenoid valve 91 opens, the gasoline 50 in the vapor state which forms the homogeneous gaseous mixture 4 contained in said enclosure 5 is transferred to a canister 92 known per se, such canister 92 equipping the majority of modern cars.

It will be noted that the exemplary embodiments of the forced recirculation mixer 1 according to the present invention which have just been described are non-limiting.

In fact, the forced recirculation mixer 1 according to the invention can be applied to fields other than that of internal combustion engines, such as chemistry, industrial processes or all devices in any field whatsoever which require the production in situ of a mixture which is homogeneous and/or precisely dosed consisting of at least one gas and at least one liquid.

The possibilities of the forced recirculation mixer 1 according to the present invention are not limited to the applications which have just been described and it must also be understood that the above description has only been provided by way of example and that it in no way limits the field of said invention, from which one would not depart by replacing the details of execution described by any other equivalent.

The invention claimed is:

1. A forced recirculation mixer (1) designed to mix at least one vaporizable liquid (2) with at least one gas (3) to be mixed so as to form a homogeneous gaseous mixture (4) characterized in that it comprises:

at least one stirring enclosure (5) whose internal cavity forms a recirculation loop (6) in which the homogeneous gaseous mixture (4) can circulate continuously, the beginning and the end of the recirculation loop (6) being combined;

at least one gas inlet duct (7) which emerges directly or indirectly into the stirring enclosure (5) and through which the gas (3) to be mixed is introduced into the recirculation loop (6) by means (8) for the introduction of gas in a known quantity;

at least one liquid injection nozzle (9) which emerges directly or indirectly into the stirring enclosure (5) to introduce the vaporizable liquid (2) into the recirculation loop (6), said nozzle (9) being fed by means (10) for introducing liquid in a controlled quantity, the vaporizable liquid (2) flow rate of which is controlled by a computer (45), said vaporizable liquid (2) forming, with the gas (3) to be mixed, the homogeneous gas mixture (4);

at least one mixture draw-off duct (11) which emerges directly or indirectly into the stirring enclosure (5) and through which the homogeneous gas mixture (4) can be drawn-off from the recirculation loop (6) by gas drawing-off means (12); and at least one stirring turbine (13) which is set in motion by a turbine motor (28) and which is positioned in the recirculation loop (6), said turbine (13) forcing the homogeneous gas mixture (4) to circulate in said loop (6).

2. The forced recirculation mixer of claim 1, characterized in that the stirring enclosure (5) comprises of at least one external coaxial duct (14), each end of which is closed by a reversing terminating end (15), at least one internal coaxial duct (16) being accommodated in the external coaxial duct (14) and a gap being left for the homogeneous gas mixture (4) to circulate, on the one hand, between each reversing terminating end (15) and the internal coaxial duct (16) and, on the other hand, between the inner face of the external coaxial duct (14) and the outer face of the internal coaxial duct (16), the direction of circulation of the homogeneous gas mixture (4) in the external coaxial duct (14) being opposite to the direction of circulation of said mixture (4) in the internal coaxial duct (16).

3. The forced recirculation mixer of claim 2, characterized in that the stirring turbine (13) is wholly or partly accommodated in one of the reversing terminating ends (15), the homogeneous gaseous mixture (4) being sucked through the center of said turbine (13) via the internal coaxial duct (16) before being discharged to the periphery of said turbine (13) via the gap left between the inner face of the external coaxial duct (14) and the outer face of the internal coaxial duct (16).

4. The forced recirculation mixer of claim 3, characterized in that the reversing terminating end (15) which accommodates the stirring turbine (13) has a hollow hemi-toroidal shape, and blades (17) which comprises the stirring turbine (13) have a complementary protruding hemi-toroidal shape, a small play being left between said terminating end (15) and said blades (17).

5. The forced recirculation mixer of claim 2, characterized in that the gas inlet duct (7) passes through one of the reversing terminating ends (15) to emerge into the internal coaxial duct (16).

6. The forced recirculation mixer of claim 5, characterized in that the reversing terminating end (15) crossed by the gas inlet duct (7) has a hollow hemi-toroidal shape from which said duct (7) emerges.

7. The forced recirculation mixer in accordance with claim 5, characterized in that the liquid injection nozzle (9) emerges into the interior of the gas inlet duct (7) or at the outlet thereof.

8. The forced recirculation mixer of claim 2, characterized in that the internal coaxial duct (16) is held in position in the external coaxial duct (14) by at least one stirring vane (22) which radially connects said internal coaxial duct (16) to said external coaxial duct (14).

9. The forced recirculation mixer of claim 2, characterized in that the external coaxial duct (14) or any of the reversing terminating ends (15) thereof is wholly or partly surrounded by a draw-off ring (23), the inside of the latter being connected to the inside of the external coaxial duct (14) by at least one radial draw-off orifice (24), the mixture draw-off duct (11) being connected to the stirring enclosure (5) by means of said ring (23) and said orifice (24).

10. The forced recirculation mixer of claim 1, characterized in that the stirring enclosure (5) comprises heating or cooling means (25).

11. The forced recirculation mixer of claim 1, characterized in that the turbine motor (28) is an electric motor (29) which comprises, on the one hand, a rotor (30) which rotationally connected to the stirring turbine (13) and which is enclosed in the stirring enclosure (5), and, on the other hand, a stator (31) which is placed outside said enclosure (5), magnetic fields produced by said stator (31) being capable to pass through the wall of the stirring enclosure (5) to cause the rotor (30) to rotate.

12. The forced recirculation mixer of claim 1, characterized in that the means (10) for introducing liquid in a controlled quantity consist of a liquid piston pump (32) which comprises a pump casing (42), said pump (32) also comprising at least one single or double acting pump piston (33) which, by the action of a piston actuator (34) cooperating with displacement control means (44), is capable to move in translation in a pump cylinder (35) to form at least one pump chamber (36) of variable volume into which the vaporizable liquid can be introduced (2) via an inlet valve (37), and from which the liquid can be expelled (2) to the liquid injection nozzle (9) via a discharge valve (38).

13. The forced recirculation mixer of claim 12, characterized in that the piston actuator (34) consists of a actuator rotary electric motor (39) secured to the pump casing (42), said motor (39) being capable to rotate in either direction to rotationally drive driving transmission means (40) which are integral in translation with the pump casing (42) and which cooperate with driven transmission means (41) which are integral in translation with the pump piston (33), said driving transmission means (40) reacting with said casing (42) to move longitudinally in translation said driven transmission means (41).

14. The forced recirculation mixer of claim 13, characterized in that the driving transmission means (40) is formed by a worm (47) which rotates a worm wheel (43) which has a wheel thread (56), the driven transmission means (41) consisting of a piston thread (57) that cooperates with the wheel thread (56).

15. The forced recirculation mixer of claim 1, characterized in that a gas mass flowmeter (46) directly or indirectly measures the mass flow rate of the gas (3) to be mixed circulating in the gas inlet duct (7) and/or the mass flow rate of the homogeneous gas mixture (4) circulating in the mixture draw-off duct (11).

16. The forced recirculation mixer of claim 1, characterized in that the means (10) for introducing liquid in a controlled quantity consist of an impulse pump (63) which comprises a single or double acting impulse pump piston (64) which, by the action of a pump solenoid actuator (65), is capable to move in translation through an impulse pump cylinder (67) with which it forms at least one impulse pump chamber (68) of variable volume into which the vaporizable liquid can be introduced (2) via an impulse pump inlet valve (69), and from which said liquid can be expelled (2) to the liquid injection nozzle (9) via an impulse pump discharge valve (70).

17. The forced recirculation mixer of claim 1, characterized in that the volume and/or mass flow rate of vaporizable liquid (2) is sent back to the computer (45) by a vaporizable liquid flowmeter (71) placed upstream or downstream of the controlled quantity liquid introduction means (10).

18. The forced recirculation mixer of claim 17, characterized in that the vaporizable liquid flowmeter (71) is constituted by a flowmeter piston (72) which can move in a sealed manner in a flowmeter cylinder (73) so as to form, on the one hand, a flowmeter upstream chamber (75) which is directly or indirectly connected to a pressure source (77), and, on the other hand, a flowmeter downstream chamber (76) which is directly or indirectly connected to the liquid injection nozzle (9), the position of said piston (72) in said cylinder (73) being transmitted to the computer (45) by a position sensor (74), a flowmeter piston return spring (78) tending to push the flowmeter piston (72) towards the flowmeter upstream chamber (75).

19. The forced recirculation mixer of claim 18, characterized in that the flowmeter upstream chamber (75) is connectable to the flowmeter downstream chamber (76) by a flowmeter piston return valve (72).

20. The forced recirculation mixer of claim 19, wherein the flowmeter piston return valve (72) comprises an orientable seal plate (85) that can be held pressed on a valve orifice (86) by a valve solenoid actuator (88).

21. The forced recirculation mixer of claim 1, characterized in that a nozzle accumulator (80) is interposed between the means for the introduction of liquid in a controlled quantity (10) and the liquid injection nozzle (9).

22. The forced recirculation mixer of claim 21, characterized in that the nozzle accumulator (80) comprises a nozzle accumulator piston (81) which, together with an accumulator cylinder (82), forms an accumulator chamber (83), said piston (81) being pushed towards said chamber (83) by an accumulator spring (84), the liquid injection nozzle (9) being integral with said piston (81) and passing through the latter right through in the lengthwise direction thereof.

* * * * *